United States Patent [19]

Frantz et al.

[11] Patent Number: 4,972,575

[45] Date of Patent: Nov. 27, 1990

[54] CIRCULAR DIN PLUG CONNECTOR METHOD

[75] Inventors: Robert H. Frantz, Newville; Benjamin H. Mosser, III, Middletown; Earl C. Myers, Jr., Harrisburg; Charles E. Reynolds, Mechanicsburg, all of Pa.

[73] Assignee: AMP Incorporated, Harrisburg, Pa.

[21] Appl. No.: 453,535

[22] Filed: Dec. 20, 1989

[51] Int. Cl.[5] ..... H01R 43/00

[52] U.S. Cl. ..... 29/858; 29/749; 29/753; 29/861; 29/566.3

[58] Field of Search ..... 29/861, 865, 866, 858, 29/749, 753, 566.3, 566.4, 566.1

[56] References Cited

U.S. PATENT DOCUMENTS

| | | | |
|---|---|---|---|
| Re. 32,864 | 2/1989 | Ezure | 439/152 |
| 3,141,717 | 8/1959 | Olsson et al. | 339/66 |
| 4,310,213 | 1/1982 | Fetterolf, Sr. | 339/103 M |
| 4,316,647 | 2/1982 | Bailey et al. | 339/91 R |
| 4,524,510 | 6/1985 | Brandeau | 29/861 |
| 4,563,810 | 1/1986 | Adlon et al. | 29/749 |
| 4,611,878 | 9/1986 | Hall et al. | 339/186 M |
| 4,634,208 | 1/1987 | Hall et al. | 339/143 R |
| 4,723,916 | 2/1988 | Fusselman et al. | 439/92 |
| 4,737,124 | 4/1988 | Ezure et al. | 439/610 |

*Primary Examiner*—Carl E. Hall
*Attorney, Agent, or Firm*—David L. Smith

[57] ABSTRACT

A method of producing a circular cross section electrical connector sub-assembly (94) comprising a tubular wire housing (10) and a contact housing (12). The wire housing (10) is placed in a jig (180) with the aid of a handling tab (100) thereon and is located in a vertical position by means of a levelling spigot on the tab (100), which is engaged with a reference surface (188) near the jig (180). Wires (W) of a shielded cable (C) are inserted from below through the housing (10) and are dressed into notches (32) therein. The contact housing (12) is then lowered onto the wire housing (10) with the aid of a handling tab (120) on the contact housing (12). A hood (48) on the contact housing (12) captures the wire housing (10) and the housihg (10 and 12) are then located vertically with the aid of the handling tabs (100 and 120). Radially projecting parts of the wires (W) are trimmed and the contact housing (12) is forced down onto the wire handling (10) fully to mate therewith. The trimmed ends of the wire end portions are enclosed between the hood (48) and the wire housing (10) in grooves (28 and 58) in the housing hood (48) and the wire housing (10). The tabs (100 and 120) are then broken off and the mated housings (10 and 12) are inserted into a screening shield (14).

11 Claims, 22 Drawing Sheets

70
44
54
70
38
12
56
54
48
52
42a
52
42c
60
60
42d
68c
68a
68a
68a
68d
42b
60
62
62
64
64
64
64
66
66
66
60
42b
62
68b
42a
68a
68b
62
10
34
32
34
23
28
24
32
23
28
24
22
28
24
26

CIRCULAR DIN PLUG CONNECTOR METHOD

FIELD OF THE INVENTION

This invention relates to the production of circular cross section DIN electrical connectors and especially to the production of a miniature DIN plug assembly and connector for shielded cable.

BACKGROUND OF THE INVENTION

There is disclosed in U.S. Pat. No. 4,723,916 a method of producing a circular cross section shielded, plug and socket connector comprising an insulating wire housing having a through axial bore from which extends a plurality of notches, the notches having slots associated therewith for receiving slotted wire connecting portions of contact elements supported by a mating, insulating contact housing. In the production of the connector, insulated wire end portions of a shielded cable are inserted through the bore in the wire housing and are located in the notches. Parts of said wire end portions which project radially from the wire housing are then severed, after which the contact housing is mated with the wire housing so that the connecting portions of the contact elements are received in the slots to make electrical contact with the wire end portions in the notches. A shielding shell is then mated with the sub-assembly so provided, so as to cover the contact housing and is connected to a drain wire of the cable.

SUMMARY OF THE INVENTION

The present invention is intended to simplify and expedite, the handling of the wire and contact housings.

According to the present invention, a wire housing is first located in a jig therefor by means of a handling tab projecting laterally from said wire housing. The wire end portions are then inserted through the bore defined by the wire housing and inserted into the notches therein. The contact housing is then lowered by means of a handling tab projecting laterally therefrom, down onto the wire housing to urge the wire end portions against the upper end of the wire housing. Radially projecting ends of the wires are then trimmed at positions beyond the notches. A downward force is then applied to the contact housing to mate it with the wire housing and the sub-assembly so produced is removed from the jig.

The handling tabs can then be broken away from the housings to allow insertion of the sub-assembly into a shielding shell which fully surrounds the mated housings. A part or parts of the shell may then be crimped about the shielding of the cable and a plastic cover molded about the shell so as to extend over the crimped connection between the cable shielding and the shell.

The handling tab of the wire housing may be provided with a levelling extension which engages a reference surface proximate to the jig. The levelling extension ensures that the wire housing is positioned vertically. This is most important when the contact housing is being lowered onto the wire housing so that the two housings are axially aligned, extending vertically for the application of the downward force to the contact housing.

In order to ensure that trimmed wire ends cannot engage the shielding shell when said sub-assembly has been inserted thereinto, the trimmed ends of the wire are pressed down into external grooves in the wire housing prior to, and during, the application of said downward force so that said trimmed ends are fully enclosed between the two insulative housings.

Further features and advantages of the invention will appear from the following description relating to the drawings.

DESCRIPTION OF THE PREFERRED EMBODIMENT

Figure 1:
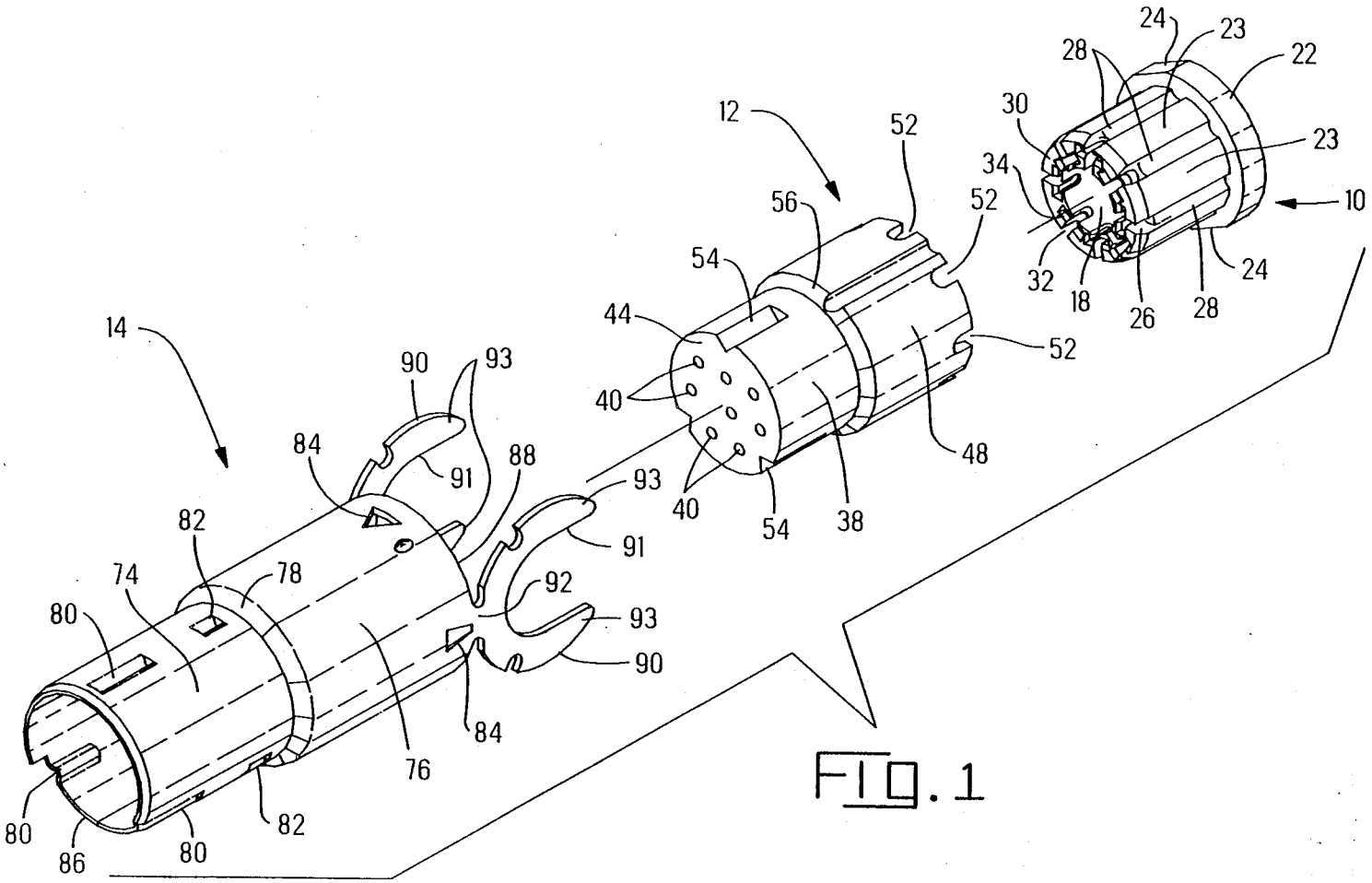
FIG. 1 is an enlarged isometric, exploded view of a miniature circular DIN plug assembly according to an embodiment of the invention, comprising a wire housing, a contact housing and a shielding shell.
Figure 2:
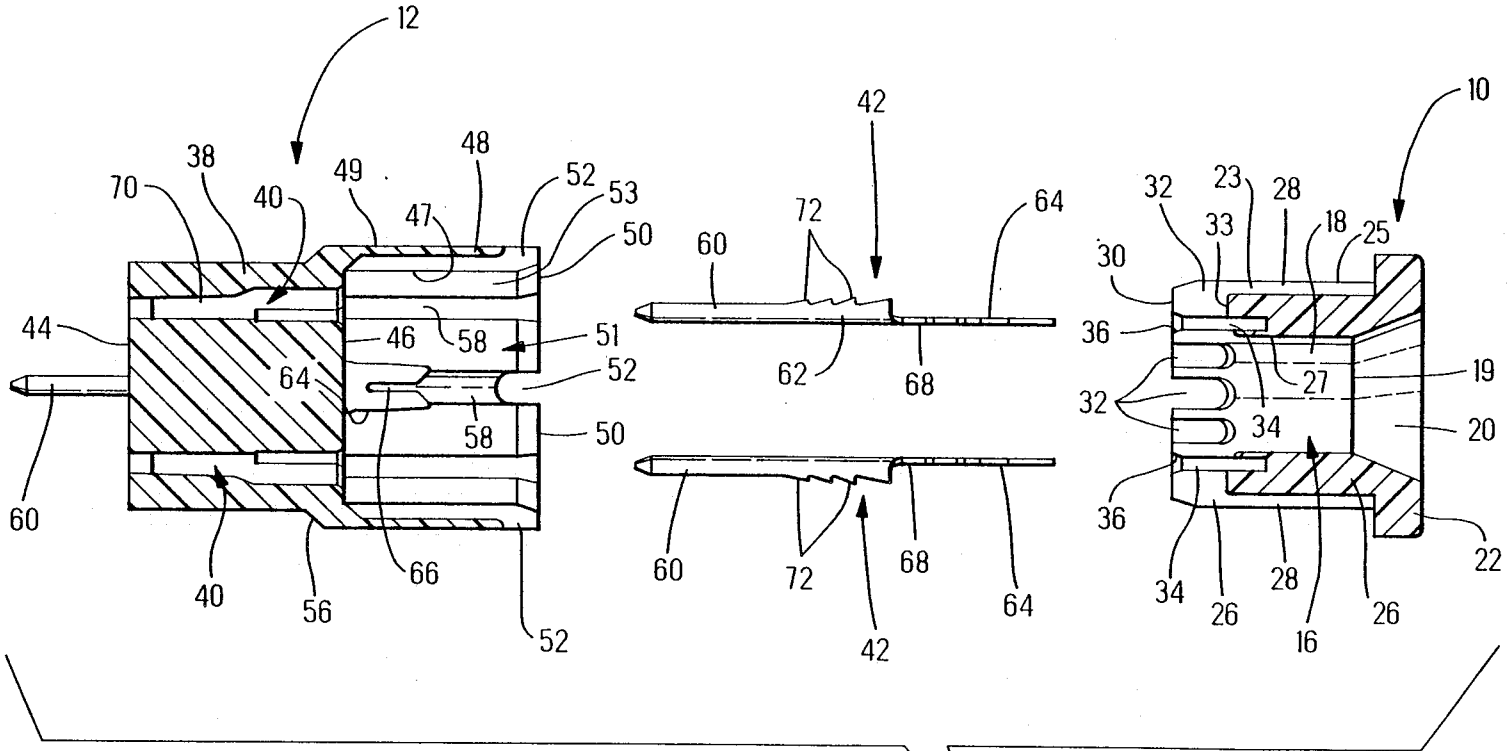
FIG. 2 is an enlarged exploded view, in longitudinal section, showing the wire housing, the contact housing and contact elements thereof.

An eight position DIN circular cross section plug assembly and the manner in which its components are assembled to a multi wire shielded cable will now be described with reference to FIGS. 1 to 9. As shown in FIG. 1, the assembly comprises three components, an insulating, wire housing 10, an insulating, contact housing 12, and a metal shielding shell 14. The wire housing 10, is tubular, defining the bore 16 which is of circular cross section, having a substantially constant cross section, forward, wire receiving part 18 opening into a rearward cable end receiving, rearwardly flared, guide mouth 20, as best seen in FIG. 2. The bore parts 18 and 20 co-operate to define a stop shoulder 19. The mouth 20 is surrounded by a rearward, collar 22 formed with opposed flats 24 but being otherwise of circular cross section. The wire receiving part 18 of bore 16 is defined by a circular wall 26 extending normally of collar 22. The inner surface 27 defines bore 16. Outer surface 25 is formed with eight parallel, wire receiving grooves 28 substantially equally spaced around the periphery of wall 26. Grooves 28 open into a mating forward end 30 of the housing 10. Each groove 28 intersects and communicates with a respective transverse radially extending wire receiving notch 32 which defines base 33 in forward end 30. Grooves 28 thus communicate with wire receiving part 18 of bore 16. In line with each notch 32 and extending through base 33 and the sides thereof, wall 26 is formed with a slot 34 for receiving a wire connecting portion of a contact element secured in housing 12. Each slot 34 has a flared, guiding mouth 36 opening into the mating face 30.

The contact housing 12 comprises a substantially cylindrical dielectric block 38 formed with eight contact element-receiving, through cavities 40, the configurations of some of which differ from one another, as described in detail below, each for receiving the electrical contact element 42, some of which also differ from one another, as described in detail below. Each cavity 40 opens at one end, into a forward mating face 44 of the block 38 and into a rear mating face 46 thereof. The face 46 has projecting rearwardly therefrom, a cylindrical hood 48 surrounding the face 46 defining concentric cylindrical inner wall 47 and outer wall 49. Within inner wall 47 is cylindrical cavity 51 sized to receive the wiring housing 10. Hood 48 extends to rearward edge 50 into which open eight radially extending wire receiving notches 52. The block 38 is also formed with three keyways 54 which open into the face 44. The keyways cooperate with structure on a mating connector to assure proper orientation prior to mating. The hood 48, which is of somewhat larger diameter than block 38, defines an inclined peripheral stop surface 56 extending thereabout. The internal surface of the hood 48 is formed with parallel, wire receiving grooves 58 each extending from the rear face 46 of block 38 and opening into a respective notch 52. Grooves 58 are recessed into inner wall 47 parallel to the axis of cylindrical block 38 and spaced around the periphery of inner wall 47 to correspond to the spacing of grooves 28 around the wire housing. In the preferred embodiment, grooves 58 are substantially equally spaced around the periphery.

Outer surface 25 of wire housing 10 between adjacent grooves 28 form ribs 23 to engage the inner wall 47 of contact housing 12. Ribs 23 position wire housing 10 transverse to the axis within cavity 51 in contact housing 12. Radially inwardly directed ribs 23 also provide a space between the wire housing and the contact housing to receive the ends of conductors.

Hood 48 has between adjacent grooves 58 radially outwardly directed rib means 53 to engage either ribs 23 or outer surface 25, whichever is present, of wire housing 10 to position wire housing 10 transverse to the axis within cavity 51 in contact housing 12. Ribs 53 provide a space between the wiring housing and the contact housing to receive the ends of conductors.

Grooves 28 and 58 are each recessed into cylindrical surfaces. Each groove receives a chordal cross section of a wire W. Typically neither groove 28 nor groove 58 of a pair of cooperating grooves receives more than about half of the cross section of a wire W received therein. A pair of grooves 28 and 58, in the preferred embodiment, cooperate to provide a wire receiving channel.

Figure 3:
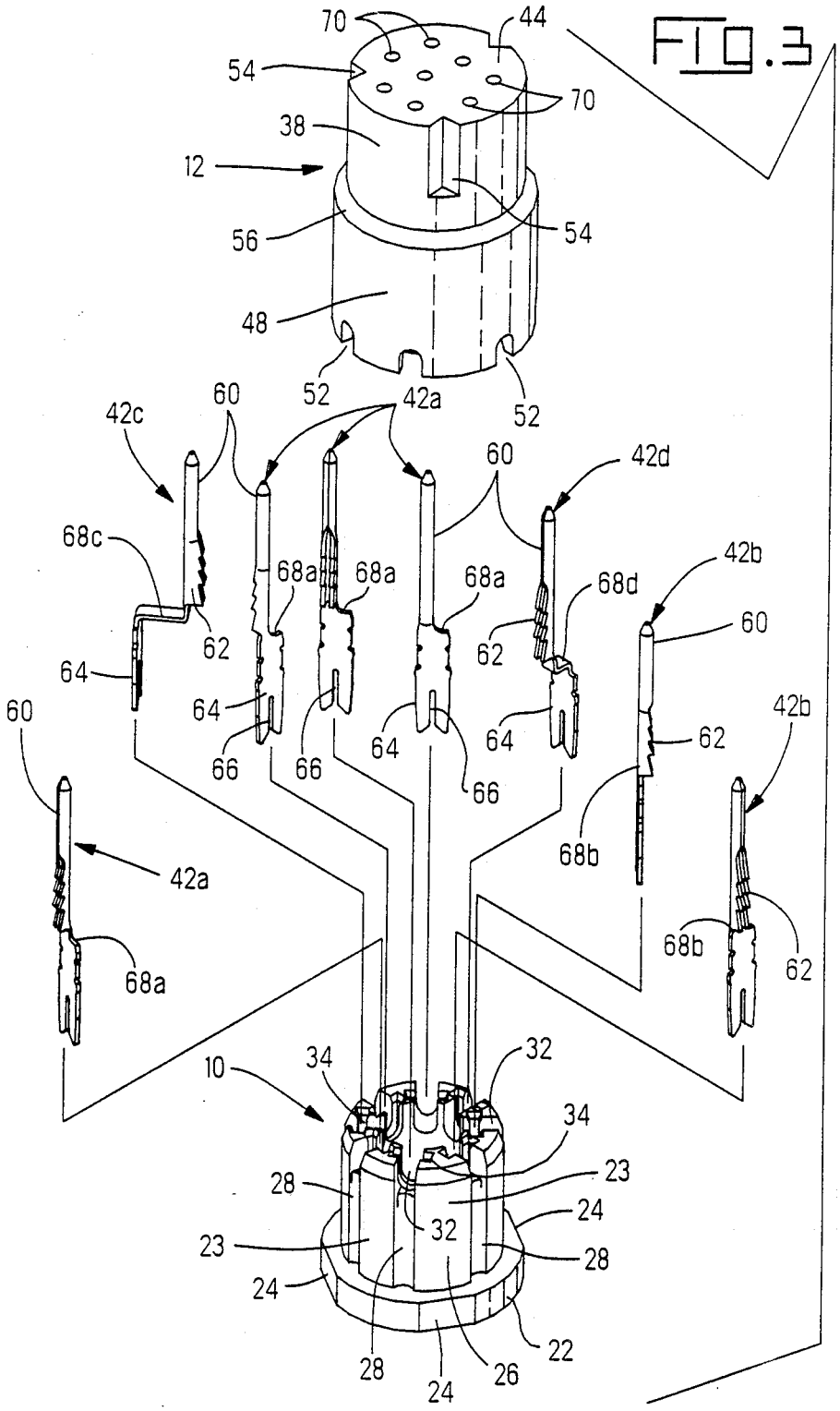
FIG. 3 is an enlarged isometric exploded view showing the said housings and contact elements.

Each contact element 42 comprises a mating portion in the form of a pin 60, a serrated anchoring portion 62 and a wire connecting portion 64 having a wire receiving slot 66, the wire connecting portion 64 being connected to the anchoring portion 62 by way of a transition portion 68. The transition portion 68 of some of the contact elements 42 are differently configured as shown in FIG. 3, for reasons explained below.

Figure 4:
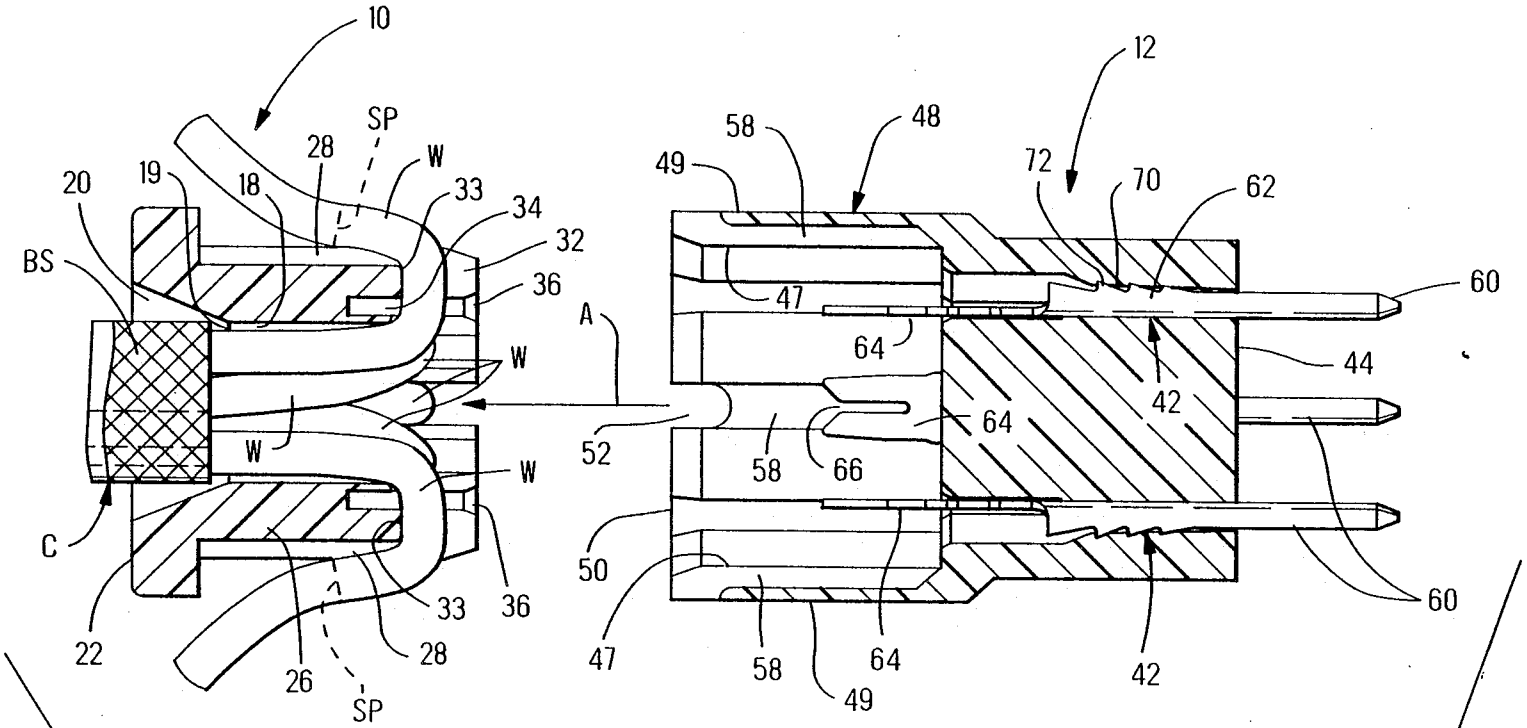
FIG. 4 is an enlarged longitudinal sectional view illustrating how the contact housing is assembled to the wire housing when the latter has been loaded with wires of a shielded cable.

The housing 12 is loaded with the contact elements 42, by inserting each contact element 42 with its pin 60 leading, by way of the hood 48, into a respective cavity 40 so that, as shown in FIG. 4, the anchoring portion 62 of each contact element 42 and the rear part of the pin 60 thereof are received in a constricted portion 70 of the respective cavity 40. Serrations 72 on the portion 62 bite into the walls of the cavity portion 70 in block 38 thereby to retain the contact element 42 therein, with the pin 60 thereof projecting from the mating face 44 of the block 38 and the wire connecting portion 64 of the contact element 42 projecting from the mating face 46 of the block 38.

The shielding shell 14 is tubular and is of circular cross section and comprises a smaller cross section forward part 74 and a larger cross section rear part 76 defining a stop shoulder 78 which is complimentary with the shoulder 56 of the housing 12. The part 74 is formed with internal longitudinal forward keys 80 and with shorter internal rear keys 82, each in line with a respective key 80, the part 76 being formed rearwardly thereof with internal keys 84 each in line with a pair of respective keys 80 and 82. The shell 14 has a forward edge 86 and rear edge 88. There project from the rear edge 88, a pair of opposed crimping lugs 90 of substantially semi-circular shape and being connected to the edge 88 by way of necks 92, the lugs 90 having braid engaging inner edges 91.

In order to load the wire housing 10 with wires, an end portion of a shielded, multiwire electrical cable C is stripped to expose the insulated wires W thereof, which in the present example, are eight in number, as well as an end portion of the metallic braid shield BS of the cable C, which shield BS is then folded back. The wires W are inserted through the bore part 18, guided by the mouth 20, until the jacket and shield abut against stop shoulder 19. The wires W are then laced into respective radial notches 32, to lie on the bases 33 thereof so as to be dressed over the slots 34, as shown in FIG. 4. The contact housing 12 loaded with contact elements 42 as described above, axially aligned with wire housing 10, then one or both of the housings are moved toward each other until mated, such as moving housing 10 in the direction of the arrow A in FIG. 4 so that the wall 26 of the housing 10 is received in the hood 48 of the housing 12. The relative movement of the wire housing and contact housing effects termination of conductors of cable C to respective contact elements. The wire connecting portion 64 of each contact element 42 enters a respective slot 34 in the wall 26 guided by the mouth 36 of the slot 34 so that the portion of each wire extending across the slot 34 is received in the wire receiving slot 66 of a respective wire connecting portion 64 whereby the edges of the slot 66 displace the insulation of the wire W so as to make permanent conductive contact with the metal core of the wire W. Each wire W is sheared off at a shear plane SP before the wire W is engaged by the respective wire connecting portion 64. As the housings 10 and 12 are being mated, the walls of the grooves 58 of the housing 12 force those parts of the wires W which lie outwardly of outer surface 25 of wall 26, into the grooves 28, whereby the half channels defined by the grooves 28 and 58 co-operate to enclose said parts of the wires, so that their sheared ends lie facing the collar 22. Part of the folded back end part of the shield BS lies in the flared mouth 20.

Figure 5:
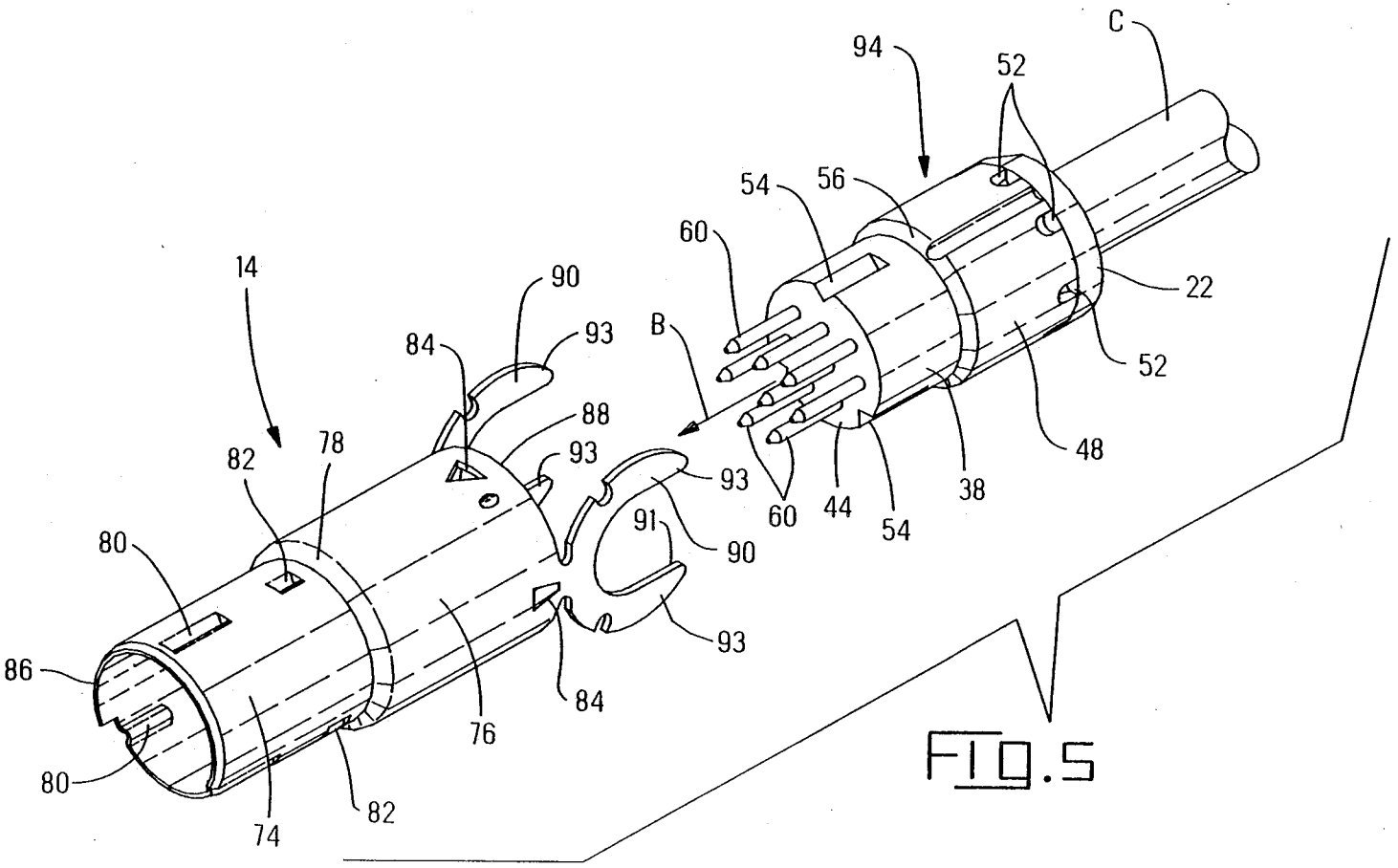
FIG. 5 is an enlarged isometric view illustrating a step in the assembly of the wire and socket housings to the shielding shell.
Figure 6:
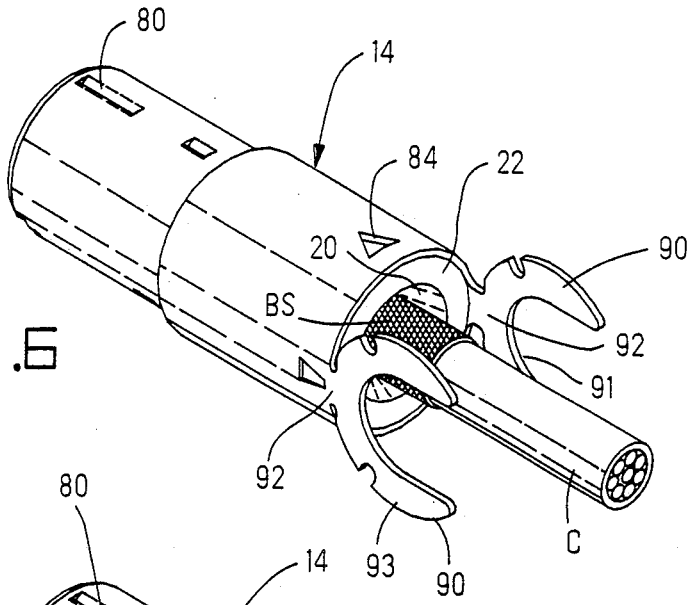
FIG. 6 is an enlarged isometric rear view of the shielding shell with the housings inserted thereinto.
Figure 7:
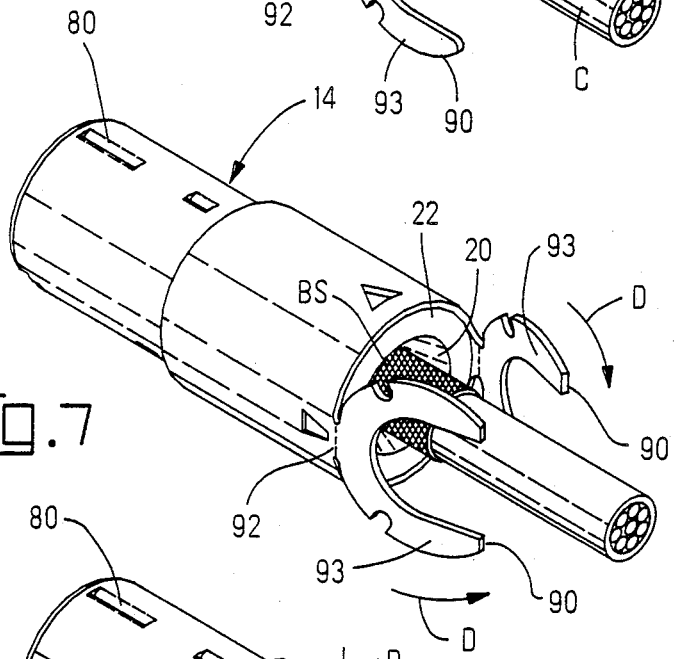
FIGS. 7 and 8 are enlarged, fragmentary rear views illustrating a further step in the assembly of the housings to the shielding shell.
Figure 8:
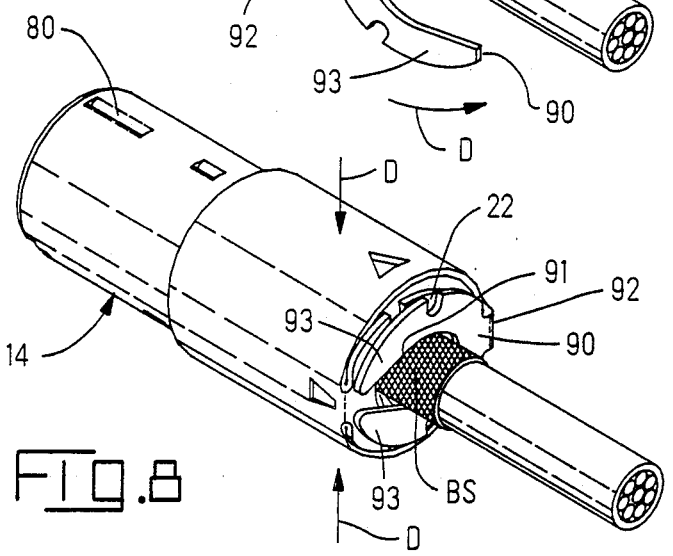
Figure 9:
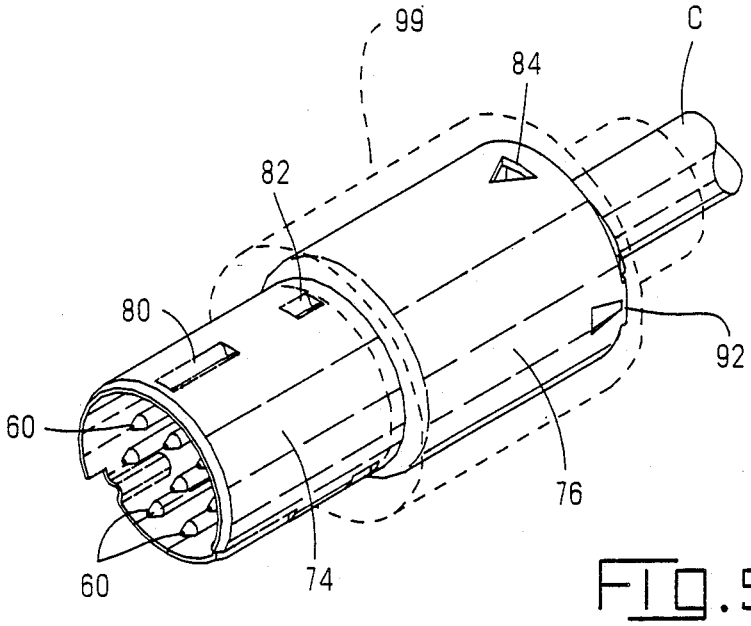
FIG. 9 is an enlarged isometric, frontal view showing the miniature DIN plug assembly in its fully assembled state.

The sub-assembly 94 provided by the assembled housings 10 and 12, is now axially aligned with the shell 14, as shown in FIG. 5, with the face 44 of the housing 12 directed towards the edge 88 of the shell 14. Shell 14 is typically stamped and formed. The sub-assembly 94 is so angularly oriented with respect to the shell 14, that each keyway 54 of the former, is aligned with the aligned keys 82 and 84 of the latter. The sub-assembly 94 is then inserted into the shell 14 guided by co-operation between the keys 54 and the keyways 82 and 84 until the stop shoulders 56 and 78 are in abutment. In this fully seated or mated position of the sub-assembly 94 and the shell 14, which is shown in FIG. 6, the lugs 90 are crimped over, as indicated by the arrows D in FIGS. 7 and 8 so that they engage the collar 22, ends 93 of each lug 90 are pressed toward each other such that inner edges 91 of the lugs 90 firmly engage the braid shield BS of the cable C making electrical and mechanical contact therewith and providing strain relief. The sub-assembly 94 is thus secured within the shell 14, against all movement with respect thereto, by virtue of the cooperation between the said keys and keyways, the abutment shoulders 56 and 78, the lugs 90 and the collar 22, the shell 14 being electrically commoned with the braid shield BS by means of the lugs 90. The part of the folded back end of the shield BS, which projects beyond the lugs 90, is then severed. The completed miniature circular DIN plug assembly is shown in FIG. 9 with the pins 60 of the contact elements 42 projecting into the part 74 of the shell 14 for mating with sockets of a DIN socket assembly (not shown), having keyways for receiving the keys 80. Since the outer portions of the wires W are snugly enclosed by the walls of the grooves 28 and 58, with the sheared ends of the wires W facing the collar 22, the wires W cannot be grounded by electrical connection with the shielding shell 14.

The assembly shown in FIG. 9 can, since it is fully surrounded by the shell 14, safely be encapsulated to provide an overmolded insulating handle 99 (shown in phantom) covering the crimped connection for the plug assembly, since the encapsulating resin cannot to any significant extent reach the sub-assembly 24 in the shell 14.

Figure 33:
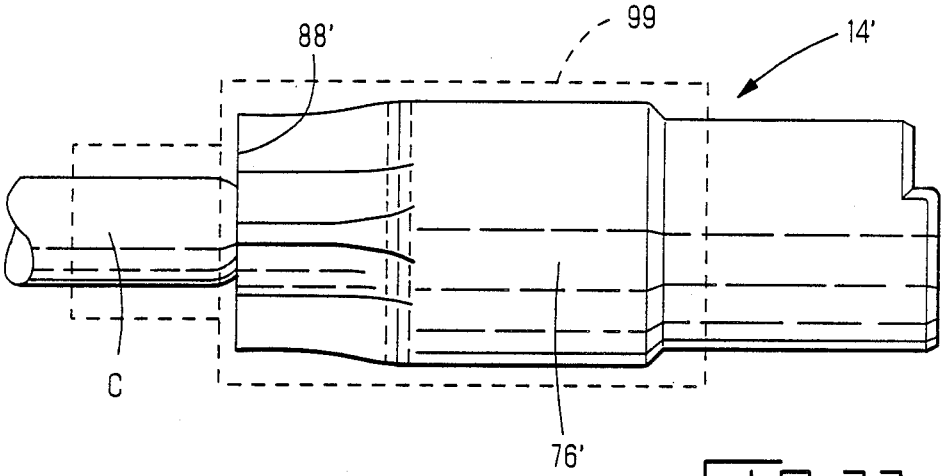
FIGS. 33 and 34 are an enlarged side view and an enlarged end view, respectively, of a miniature DIN plug assembly having an alternate embodiment shielding shell.
Figure 34:
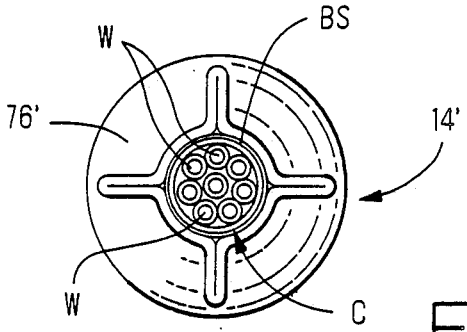

For absolute protection of the sub-assembly 94 against the encapsulating resin, the lugs 90 may be omitted from the shell 14,, which is a seamless drawn shell, as shown in FIGS. 33 and 34 and the rear end portion of the part 76 thereof crimped firmly about the braid shield BS of the cable C by means of indenting tooling (not shown) providing a star shaped crimp, best seen in FIG. 34. The shell 14, is designed for crimping to multiple different diameters of cable to provide electrical continuity with the braid and strain relief to the cable.

Figure 27:
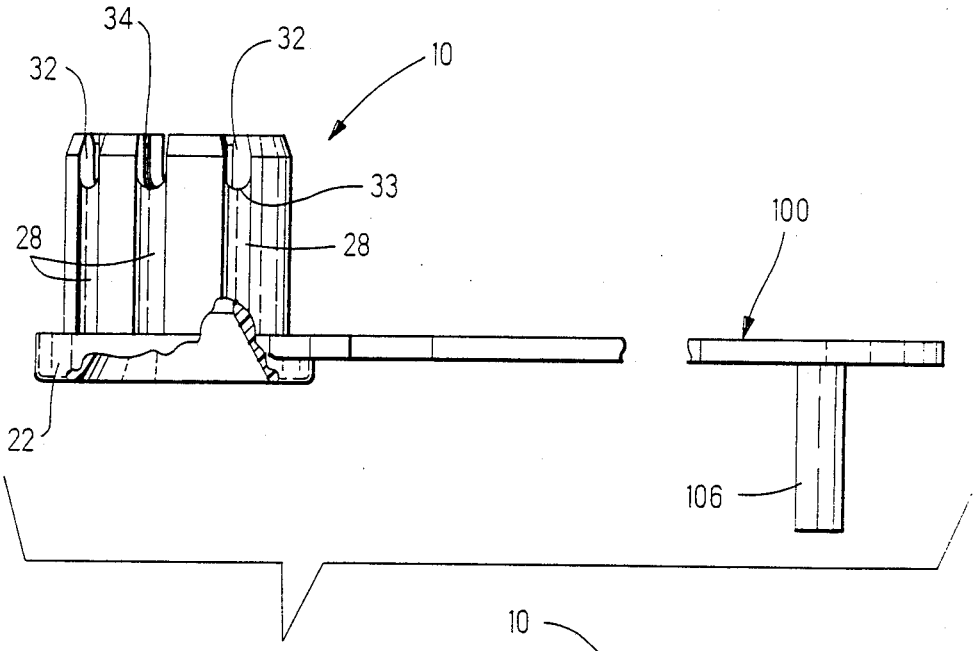
FIG. 27 is an enlarged side view, shown partly in section, of the, wire housing.
Figure 28:
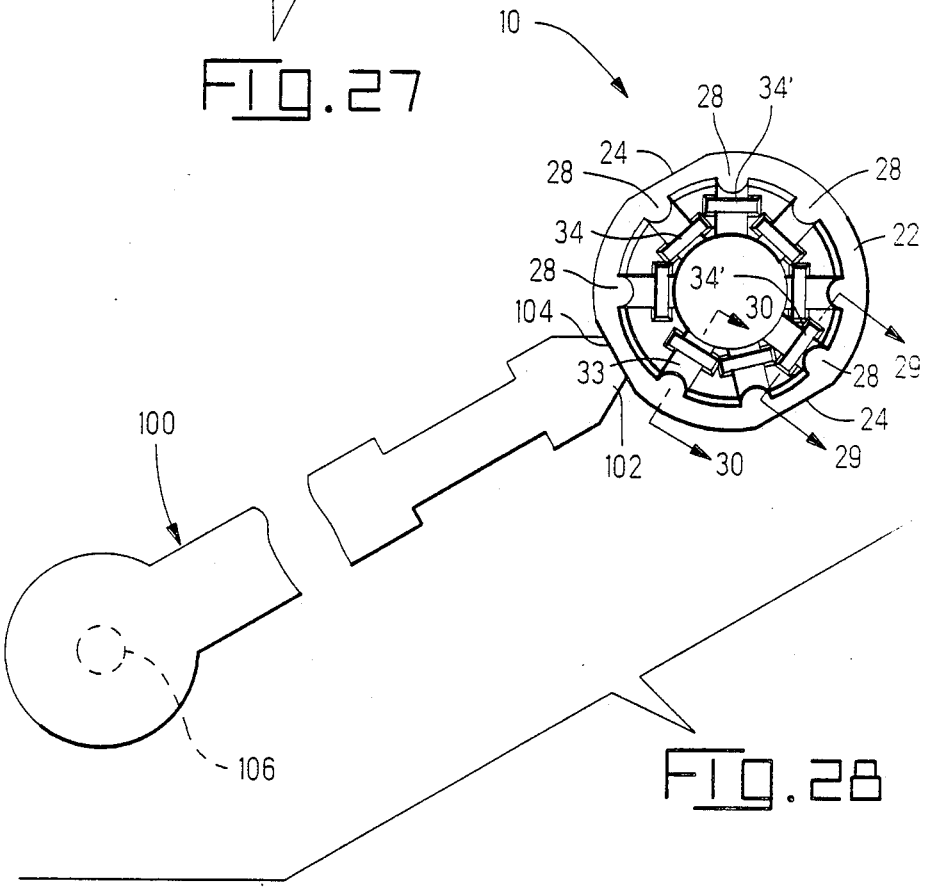
FIG. 28 is an enlarged top plan view of the wire housing.
Figure 29:
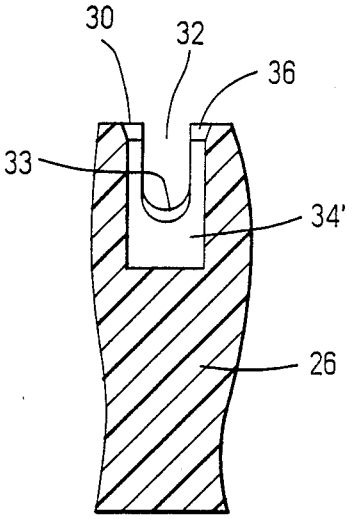
FIGS. 29 and 30 are views taken on the lines 29—29 and 30—30 respectively of FIG. 28.
Figure 30:
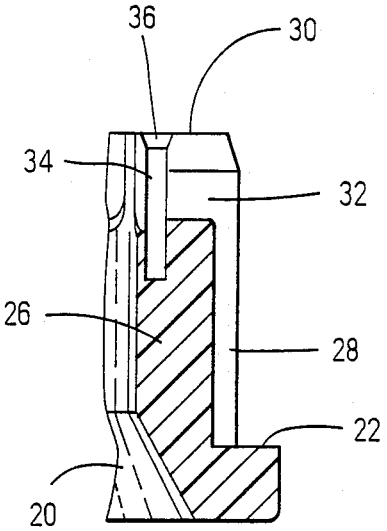

The wire housing 10 will now be described in greater detail with reference to FIGS. 27 to 30. As shown in FIGS. 27 and 28, the housing 10 is provided with a handling tab 100 parallel to the flats 24, to facilitate handling the housing 10 in a preferred method of assembling it to the housing 12, which is described in detail below. The tab 100 is connected to the collar 22 of the housing 10 by a reduced cross section portion 102 which is formed integrally with a further flat 104 on the collar 22 and which can be broken off therefrom at a position which is slightly inward of the arcuate outer periphery of the collar 22, by virtue of the flat 104. Proximate to its end opposite to the portion 102, the tab 100 has a depending leveling extension 106 projecting below the housing 10, as shown in FIG. 27. As shown in FIG. 28, the slots 44 are distributed about the center of the housing 10 inwardly of the outer surface 25 of the wall 26. Six of the slots 34 are equally spaced from the center of the housing 10 but two other slots, which are referenced 34, are spaced from the center of the housing 10 by a slightly greater distance. As best seen in FIGS. 29 and 30, notches 32 are of sufficient depth to enable the wires W to be dressed thereinto so that they do not protrude above mating face 30 of the housing 10, thereby ensuring that contact housing 12 will seat properly on the housing 10 when it is assembled thereto as described above.

Figure 10:
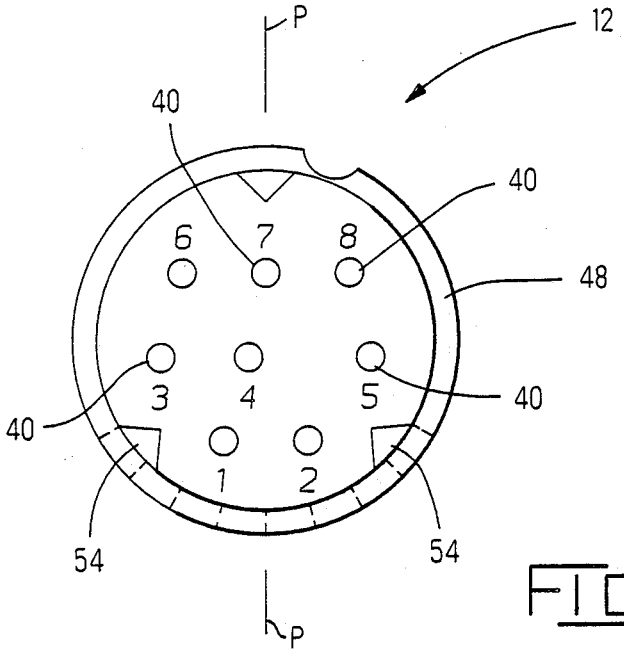
FIGS. 10, 11 and 12 are, an enlarged front end view, an enlarged side view, shown partly in section, and an enlarged rear end view, respectively, of the contact housing.
Figure 11:
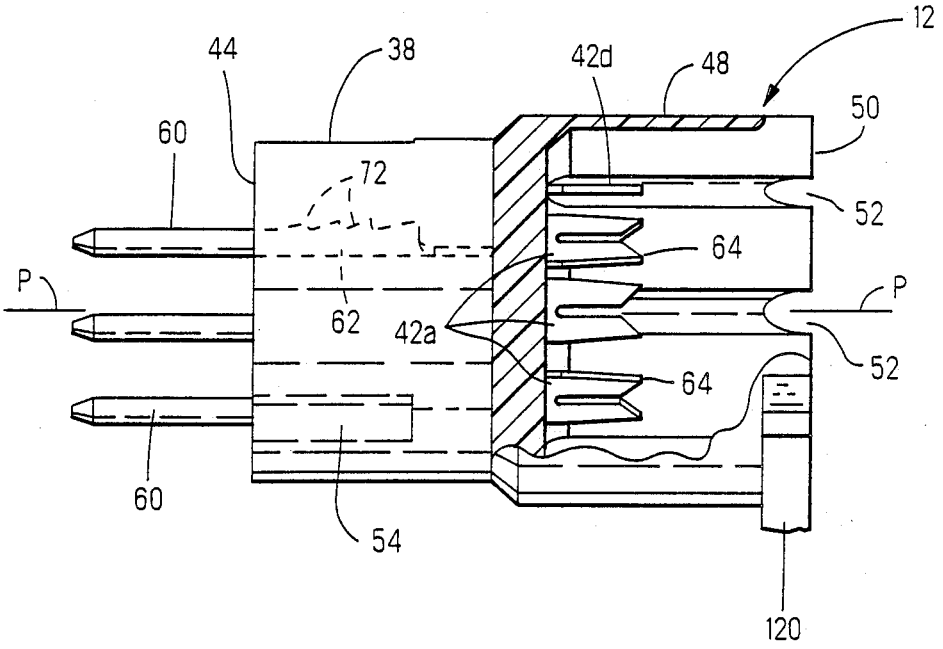
Figure 12:
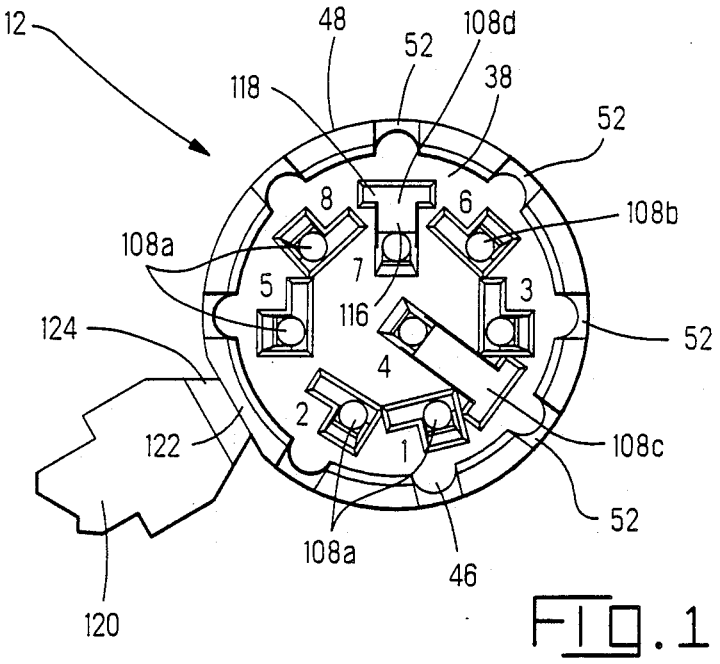
Figure 13:
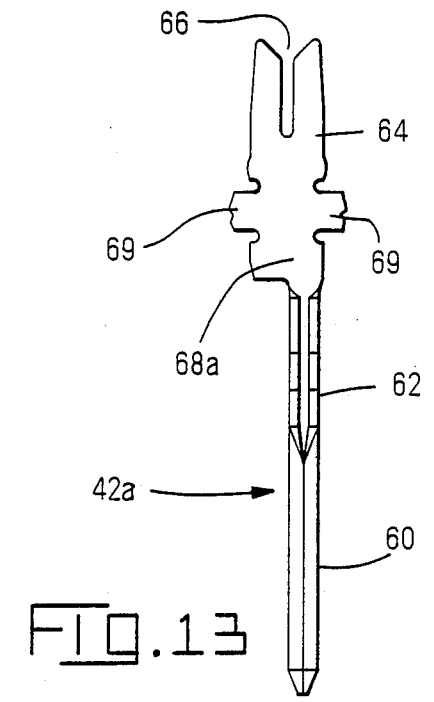
FIGS. 13 to 16 enlarged elevational views of respective contact elements of the contact housing.
Figure 14:
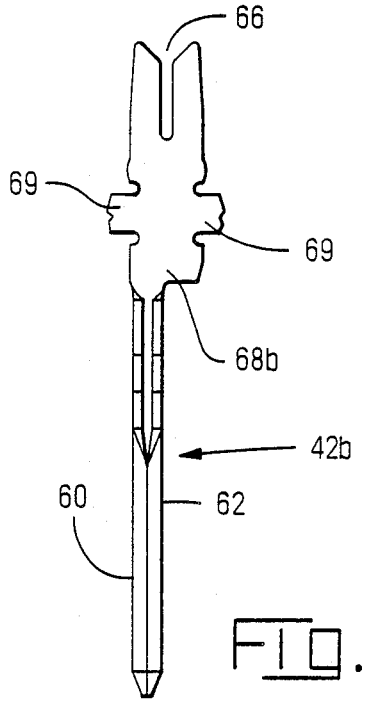
Figure 15:
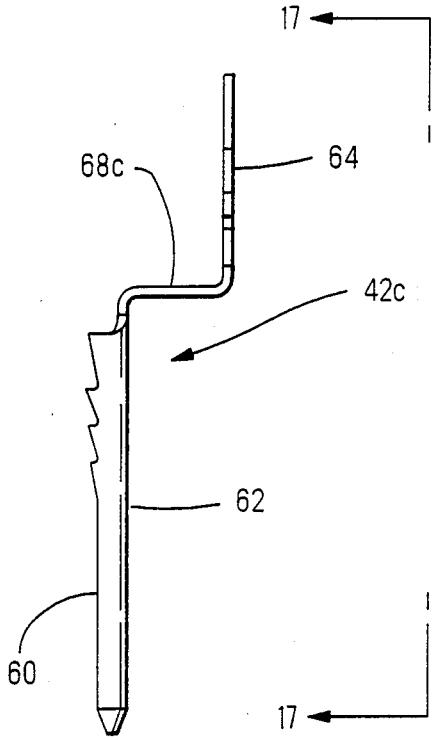
Figure 16:
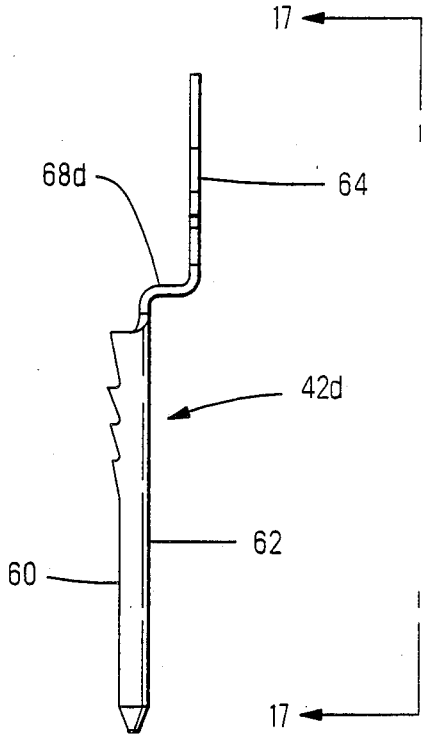
Figure 17:
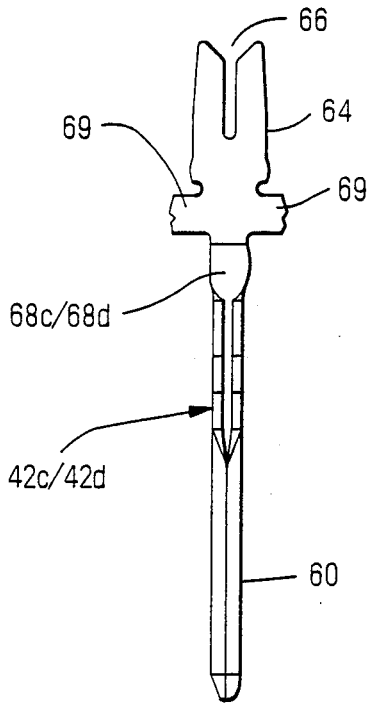
FIG. 17 is a view of either of the contact elements shown in FIGS. 15 and 16, taken in the direction of the arrow 17 in each of these FIGS.

The contact housing 12 will now be further described with reference to FIGS. 10 to 19. As shown in FIG. 10, the pins 60 of the contact elements 42 are, according to a DIN standard, required to be located at pre-determined positions with respect to the center of the housing 12 but not in the same array as the slots 34 and 34, of the housing 10 and to be closely spaced it will be apparent from FIG. 10 and 12 that the standard requires a high contact density. The contact positions are numbered 1 to 8 in FIGS. 10 and 12. Typically from three to eight positions receive contact elements. It will be apparent from a comparison of FIGS. 10 and 28, that each contact element must be configured so that its wire connecting portion 64 enters a respective slot 34 or 34, as the case may be when the housings 10 and 12 are mated, and to this end, rear portions **108*a*, 108*b*, 108*c* and 108*d* of the cavities 40 in the block 38, which portions receive the transition portions 68 of the contact elements 42, must be differently configured as shown in FIG. 12, the contact elements 42, which are referenced 42*a* to 42*d* in FIGS. 3 and 13 to 17, having differently configured transition portions 68 which are referenced 68*a* of the contact elements 42*a*, which are to be received in the cavities 40 at the positions 1, 2, 5, and 8, (see FIG. 10) are shaped to offset the wire connecting portion 64 of the contact element 42*a* laterally leftwardly from the pin 60 thereof, as shown in FIG. 13. The transition portions 68***b* of contact elements 42*b* for reception in the cavities 40 at the positions 3 and 6 are shaped to offset the wire connecting portion 64 from the pin 60 rightwardly as shown in FIG. 14. These offsets provide that the center of wire receiving slot 66 is laterally spaced from the axis of pin 60 in contact elements 42*a*and 42*b*. As shown in FIG. 15, the transition portion 68*c* of the contact element 42*c* for reception in the cavity 40 at position 4 is shaped to offset the wire connecting portion 64 of the contact element 42*c* from its pin 60 by a substantial distance rightwardly out of the plane of the pin 60, or equivalently pin 60 out of the plane of wire connection portion 64, since position 4 is spaced a commensurate distance inwardly of the periphery of the face 46 of the housing 12 shown in FIG. 12. As shown in FIG. 16, the transition portion 48*d* of the contact element 42*d* for reception in the cavity 40 at position 7 serves similarly to offset the wire connecting portion 64 of the contact element rightwardly of the plane of the pin 60, or equivalently pin 60 out of the plane of wire connecting portion 64, by a lesser distance than does the portion 68*c* of the contact element 42*c*, since position 7 is nearer to the periphery of the face 46 than position 4. FIG. 17 shows either of the contact elements 42*c* and 42*d* from a position at right angles to the plane the wire connecting portion 64. It will be apparent from the foregoing that contact elements 42*a* and 42*b* are coplanar whereas the contact elements 42*c* and 42*d* are not. Each contact element 42*a* to 42*d* is provided between its transition portion and its wire connecting portion 64, with a pair of locating wings 69.

Figure 18:
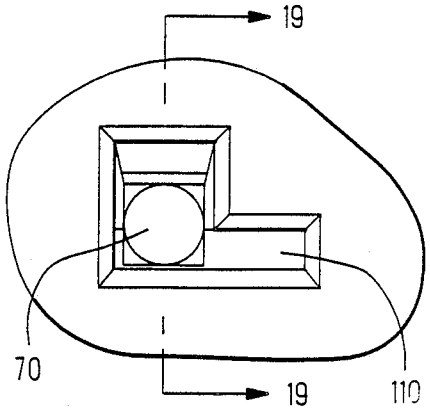
FIG. 18 is an enlarged top view of a contact element shown in FIG. 12.
Figure 19:
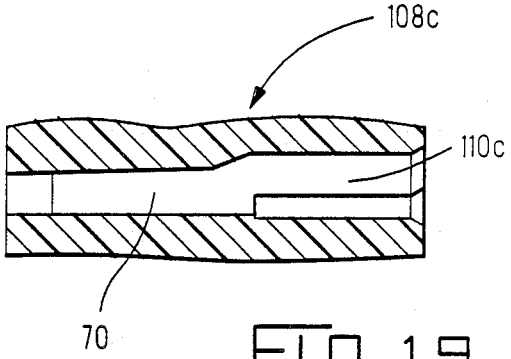
FIG. 19 is a view taken on the lines 19—19 of FIG. 18.

FIGS. 18 and 19 show one of the cavity portions 108*a* at positions 1, 2, 5 and 8. The cavity portions 108*b* at positions 3 and 6 are of the same shape as the cavity portions 108*a* but are oriented in mirror image relationship with respect thereto. Each cavity portion 108*a* and 108*b* comprises a slot 110 for the transition portion 68*a* or 68*b* as the case may be, and the locating wings 69.

Figure 20:
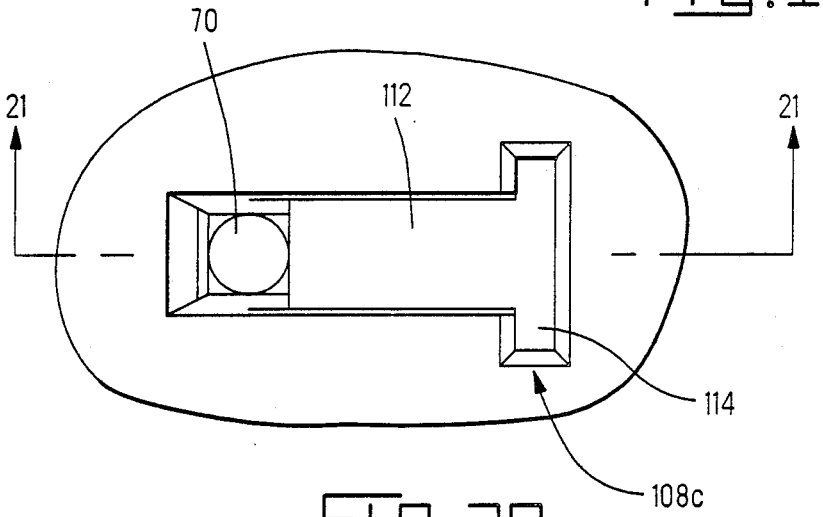
FIG. 20 is a top plan view of another contact element receiving cavity shown in FIG. 12.
Figure 21:
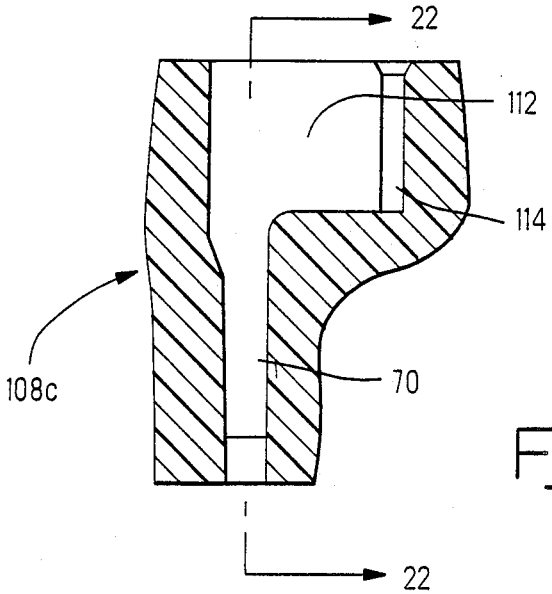
FIG. 21 is a view taken on the lines 21—21 of FIG. 20.
Figure 22:
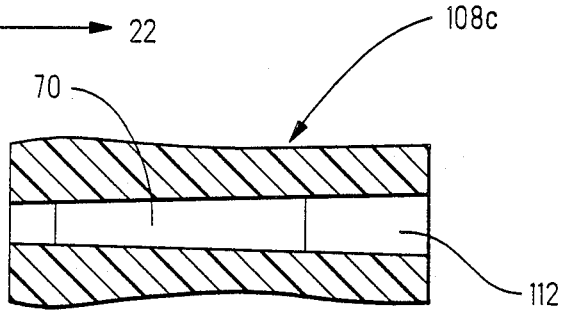
FIG. 22 is a view taken on the lines 22—22 of FIG. 21.

FIGS. 20 to 22 show the cavity portion 108*c* at position 4, which comprises an elongate slot 112 extending radially outwardly of the cavity portion 70, with which it communicates, for receiving the transition portion 68*c* of the contact element 42*c* and terminating in a transverse slot 114 extending normally of the slot 112 for receiving the locating wings 69 of that contact element. The cavity portion 108*d* (FIG. 12) is similar to the cavity portion 108*c* but has an elongate slot 116 which is shorter than the slot 112, for receiving the transition portion 68*d* of the contact element 42*d* and which terminates in a transverse slot 118 extending normally of the slot 116 for receiving the locating wings 69 of the contact element 42*d*.

As will be apparent from FIG. 12, the slots 110 of the cavity portion 108*a* and 108*b* at positions 3 and 5 extend parallel to a longitudinal central plane P—P (FIGS. 10 and 11) of the housing 12, the slots 110 of the cavity portions 108*a* and 108*b* at positions 6 and 8 being angled with respect to the plane P—P by 50°, and the slot 110 of the cavity portion 108*a* at position 2 being angled by 60° with respect to the plane P—P and the slot 110 of the cavity portion 108*a* at position 1 being angled by 70° with respect to the plane P—P. The slot 114 of the cavity portion 108*c* at position 4 is angled by 40° with respect to the plane P—P. The slot 118 of the cavity portion 108*d* at position 7 is angled by 90° with respect to the plane P—P. the slot 112 is angled by 50° with respect to the plane P—P and the slot 116 by 0° with respect thereto. The wire connecting portions 64 of the contact elements 42*a* to 42*d* at the positions mentioned above are angled with respect to the plane P—P in the same way as the respective transverse slots receiving the wings 69, so as to conform with the positioning of the respective slots 34 and 34' in the wall 26 of the wire housing 10.

For use in assembling the contact housing 12 to the housing 10, the housing 12 is provided with a handling tab 120 frangibly connected by way of a reduced cross-section portion 124, to a flat 122 adjacent to the edge 50 of the hood 48. The tab 120 is the same as the tab 100 excepting that it is not provided with a projecting spigot.

Figure 23:
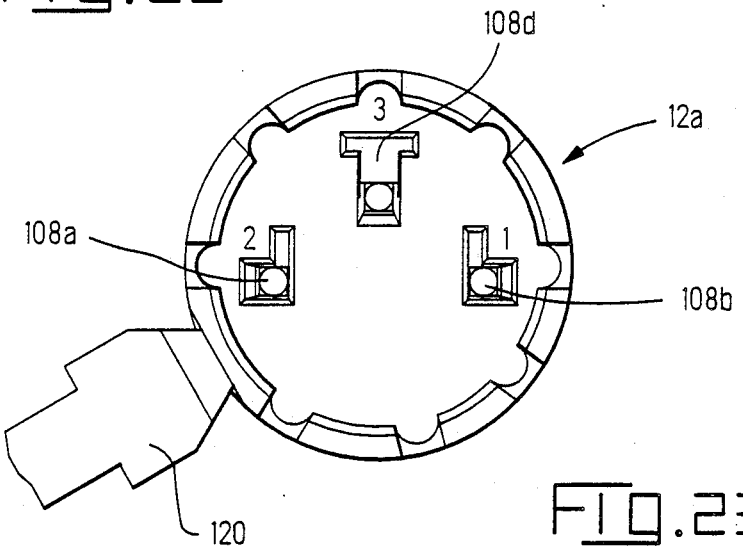
FIGS. 23 to 26 are enlarged rear end views of a three position, a four position, a five position, and a six position, contact housing, respectively.
Figure 24:
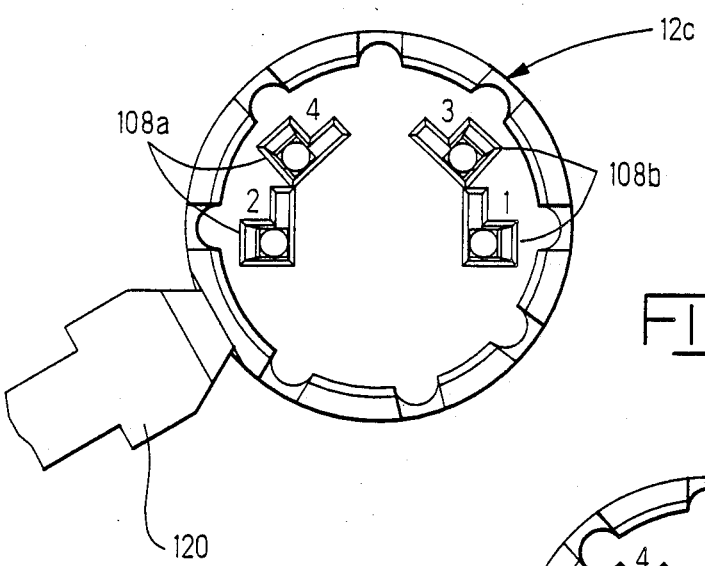
Figure 25:
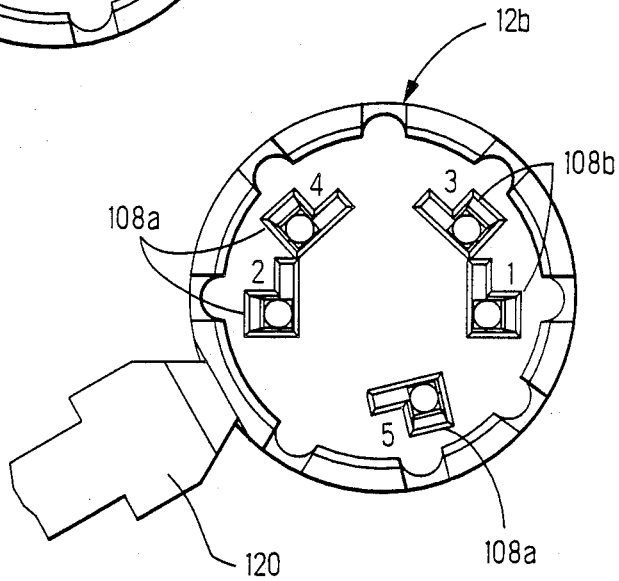
Figure 26:
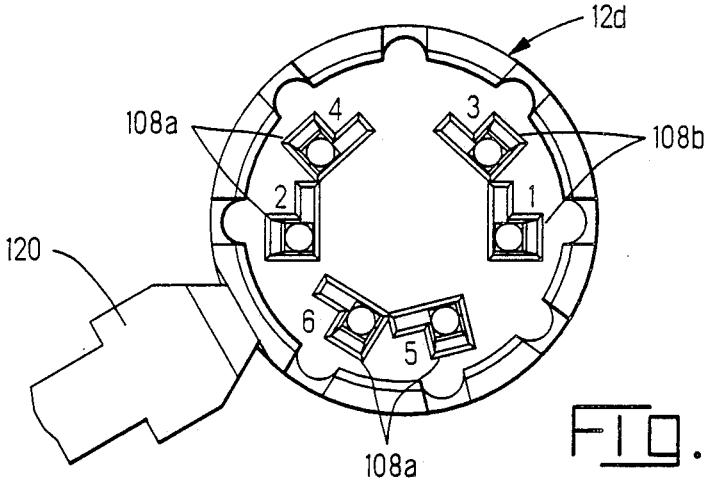

FIGS. 23 to 25 show, in top plan view, respective embodiments 12*a* to 12*d* of the contact housing, having three, four, five and six contact element positions respectively, numbered 1 to 6, respectively, the cavity portions at these positions being referenced as in FIG. 12 and each cavity portion being configured and angled in the same way as a corresponding cavity portion of the housing 12. Thus each of the contact housings 12*a* and 12*d* can be used with the same wire housing 10, the housing 10 to being wired only in the respect of those slots 34 or 34' as the case may be, which correspond to the contact element positions provided in the mating housing 12*a*, 12*b*, 12*c* or 12*d*. The housings 12*a* to 12*d* could be identical, contact elements 42 being loaded only in those cavities that are shown in FIGS. 12*a* to 12*d*, so that only two molds, for the respective housing 12 to 12*d*, need to be tooled.

Figure 31:
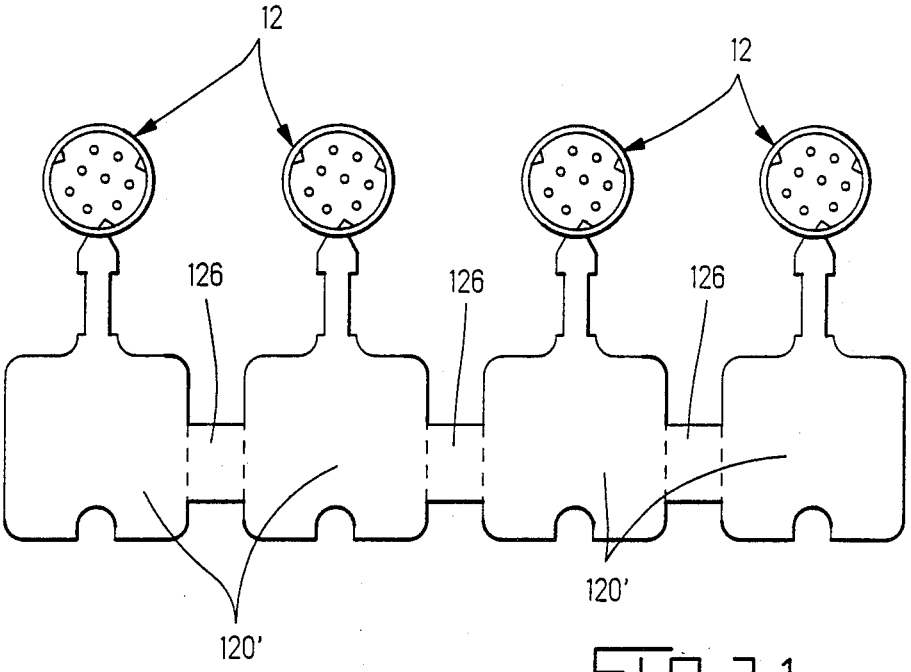
FIGS. 31 and 32 are a front view and a side view, respectively, illustrating a step in the manufacture of a series of the contact housings.
Figure 32:
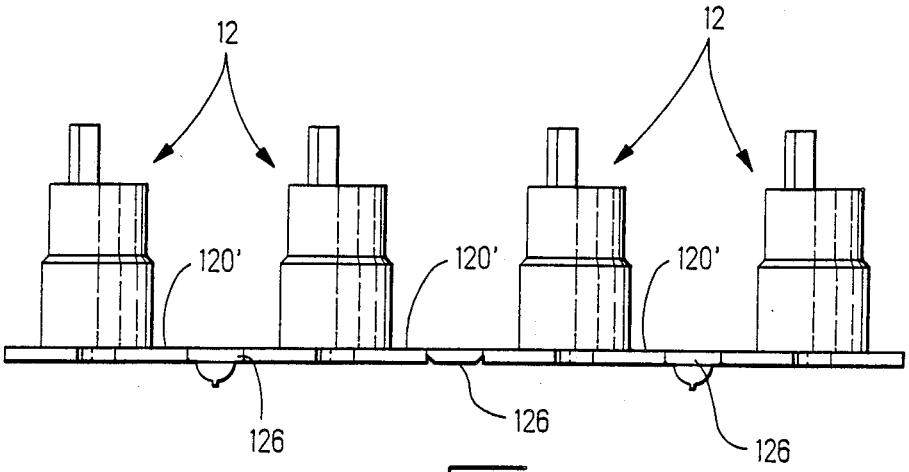

As shown in FIGS. 31 and 32, housings 12 or for that matter housing 10, can be molded in groups of housings, groups of four housings according to the present example, the housings of each group being joined by slugs 126 of the housing material, which connected webs 120' thereof from which the tabs 120 of the housings are subsequently cut.

A practical method of manufacturing the sub-assembly 94 will now be described with reference to FIGS. 35 to 43.

Figure 35:
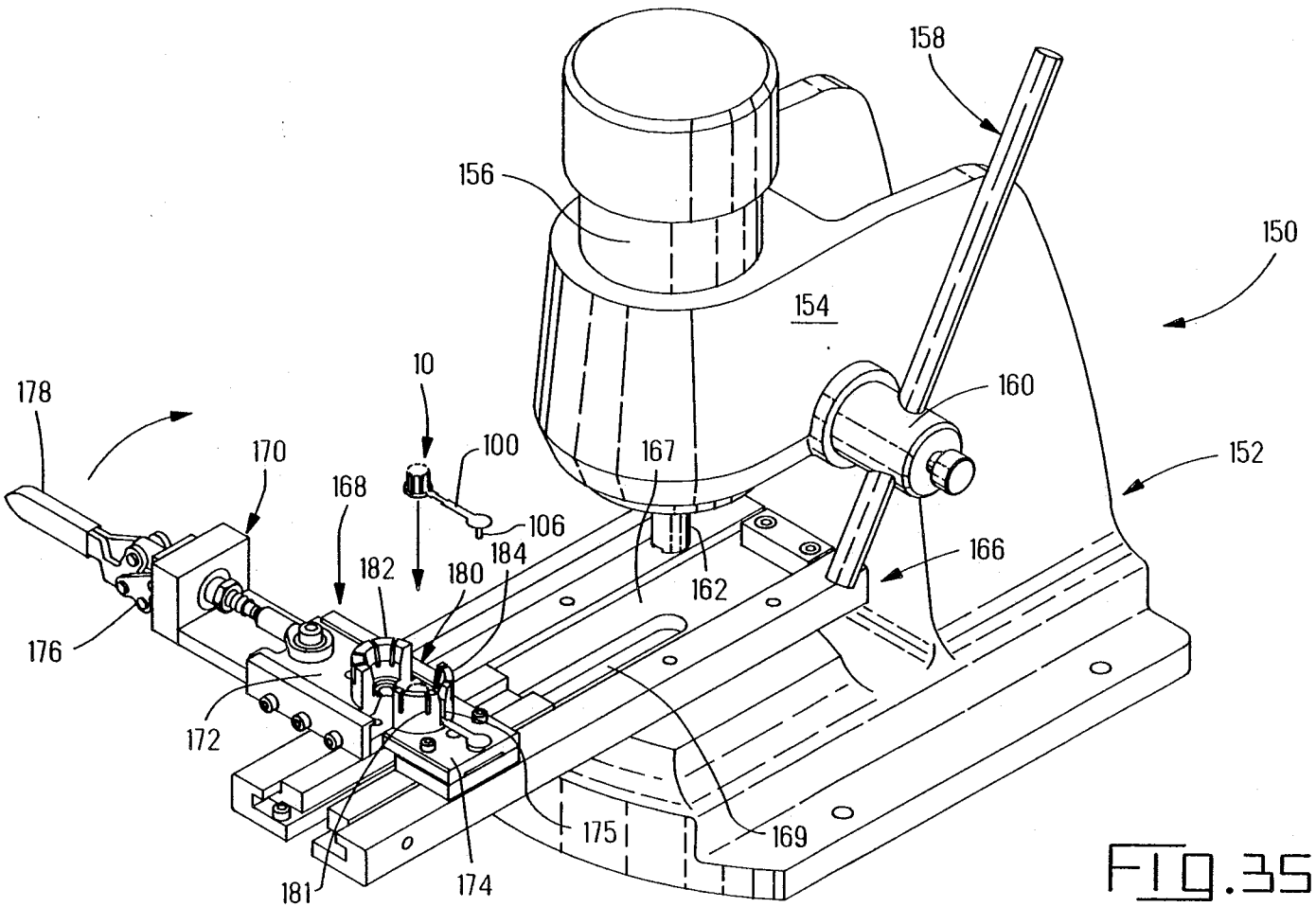
FIGS. 35 to 40: are isometric views illustrating respective steps in a method of manufacturing a subassembly of the miniature DIN plug assembly.
Figure 36:
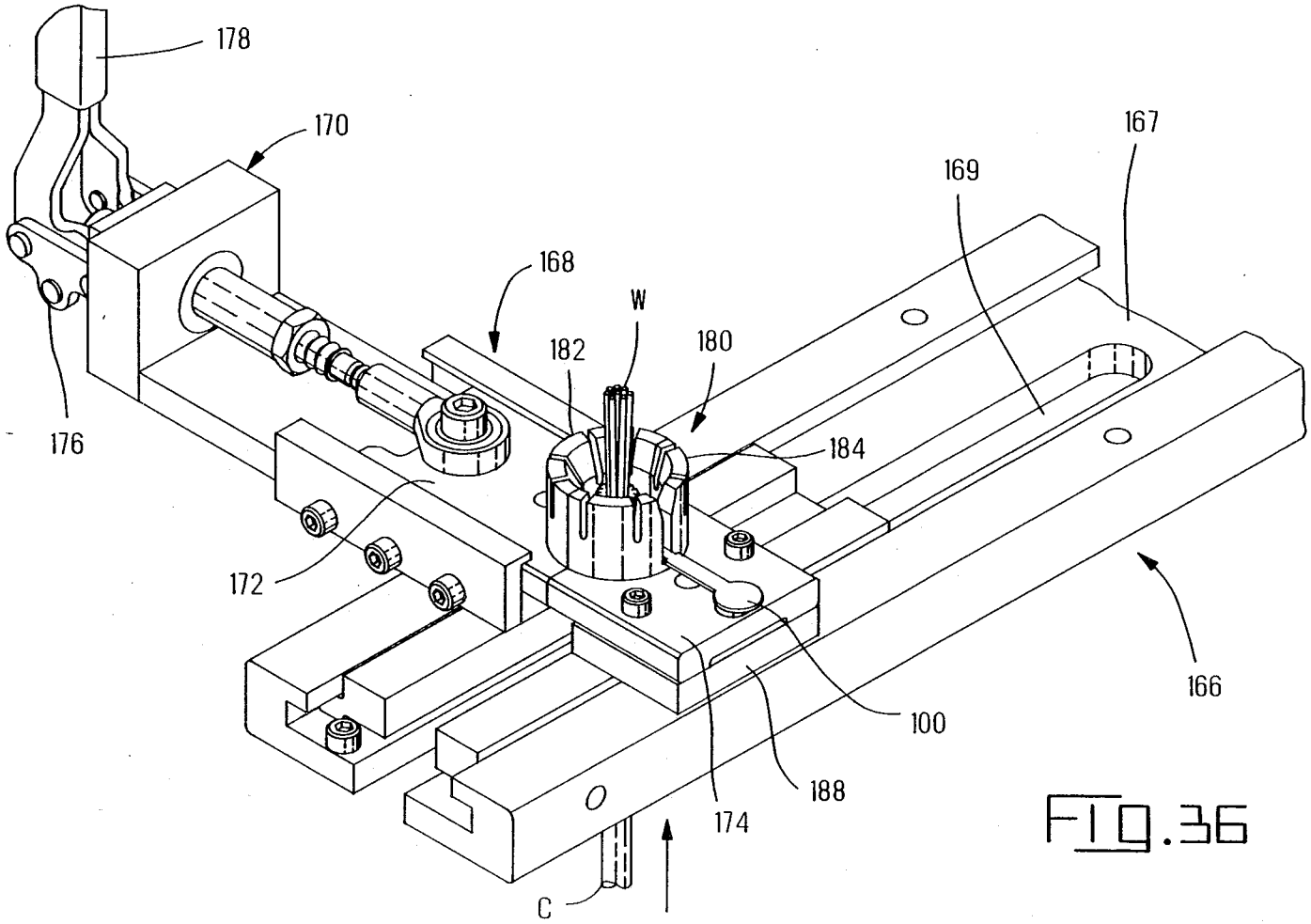
Figure 37:
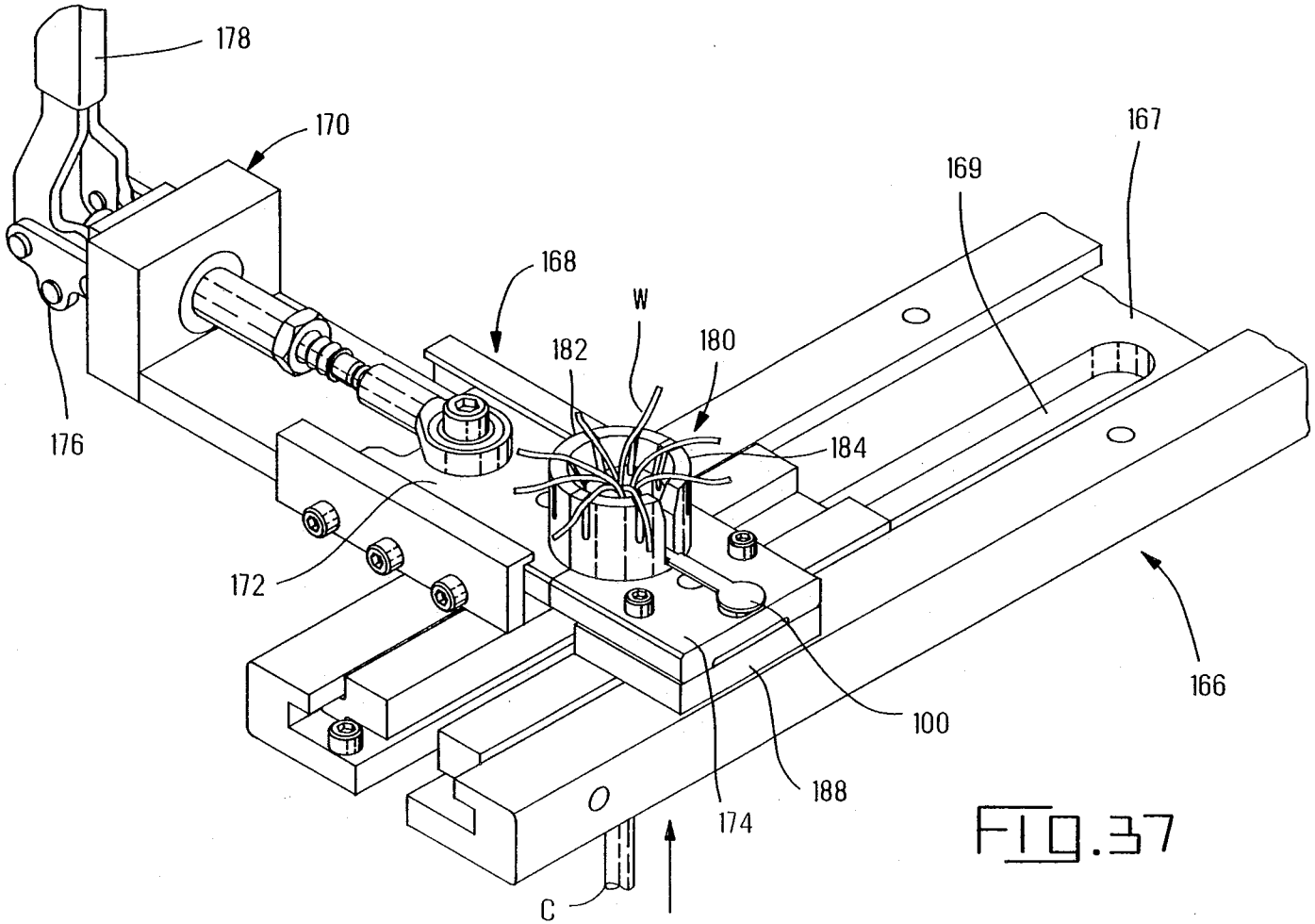
Figure 38:
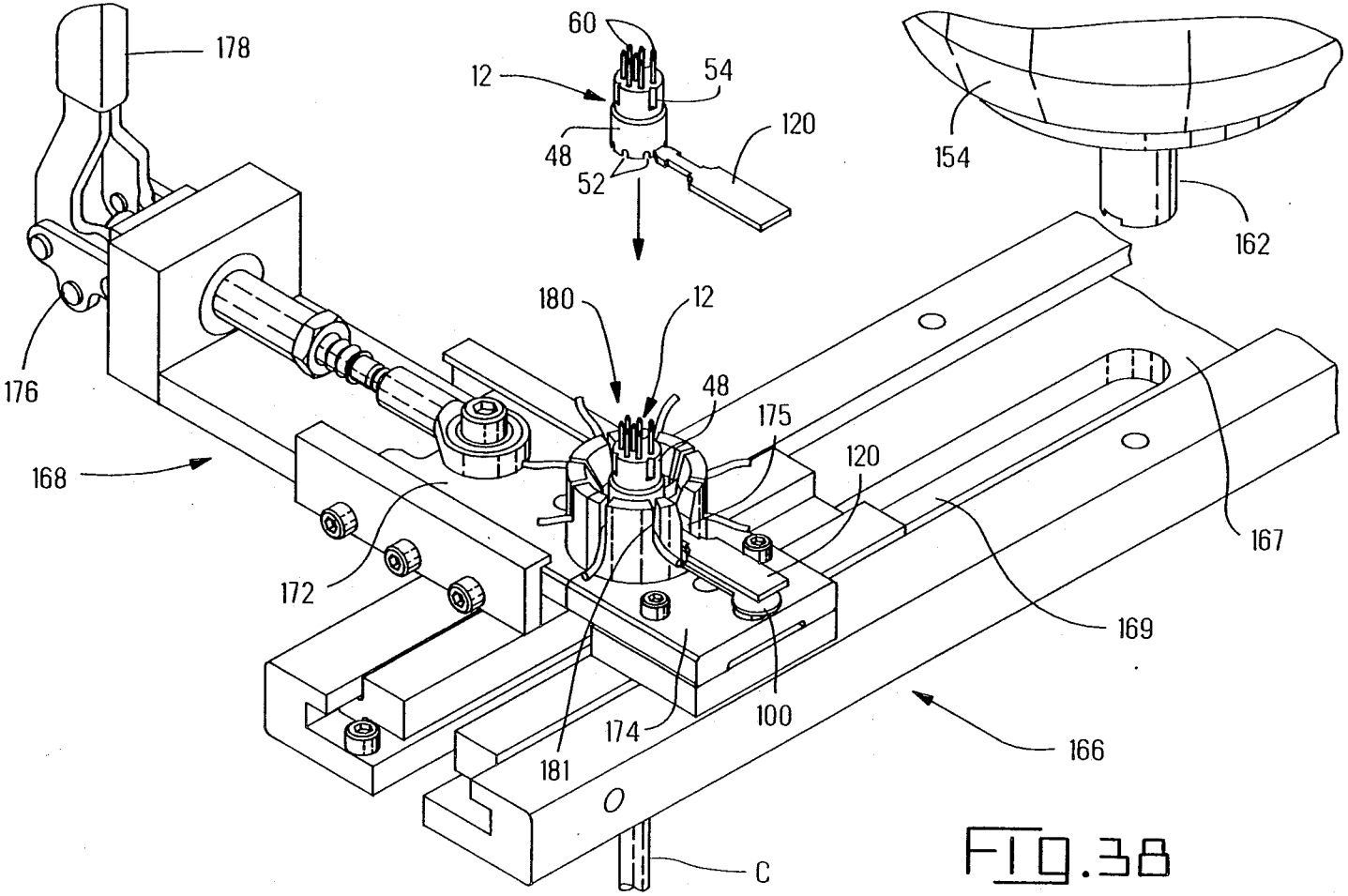
Figure 41:
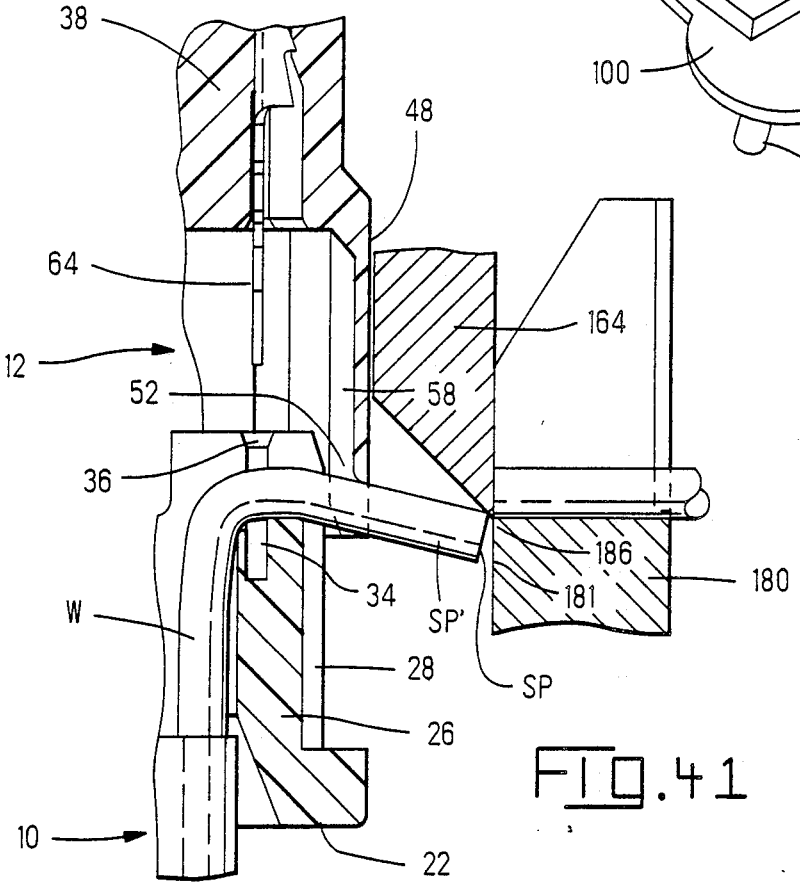
FIGS. 41 to 43 are fragmentary sectional views illustrating some respective steps of said method, in detail.

Briefly stated, the press 150 comprises a frame 152; a ram housing 154; a ram 156 slidable vertically therein; a ram drive handle 158 coupled to the ram 156 by way of a shaft 160 and gear means (not shown); an applicator head 162 on the ram 156; a crown of light shear blades 164 (one of which is shown in FIG. 41) depending from the head 162; a horizontal slideway 166 on the frame 152 having a base 167 formed with a longitudinal through slot 169; a slide 168 which is slidable along the slideway 166; a clamp 170 on the slide 168 having a movable part 172 and fixed part 174; a toggle mechanism 176 having an operating handle 178 for moving the part 132 towards and away from the part 174; and a hinge in the form of a two-part applicator nest 180 having a first half 182 on the part 172 and a second half 184 on the fixed part 174, having a vertical through slot 175. The nest 180 has a ring of light blind slots 181 which open into its upper edge, and the bottom inner edges 182 of which define shear edge 186. With the slide 168 secured at the end of the slideway 155, remote from the ram 166, the ram 166 being in a raised position, and the handle 178 being in a lowered position so that the clamp 170 and the nest 180 are both in an open position as shown in FIG. 35, the operator inserts a wire housing 10 into the open nest 180 by means of the handling tab 100 of the housing 10, the tab 100 being received in the slot 175 of the nest half 184, until the free end of the spigot 106 of the tab 100 engages a horizontal reference surface 188 of the slide 168 (as best seen in FIGS. 36 to 38) so that the housing 10 is correctly oriented and levelled with respect to the open nest 180 so that it is correctly seated therein. The handle 178 is then raised to close the clamp 170 and thus the nest 180. The cable C having been stripped and having its braid shield 135 folded back, as described above, the stripped end of the cable C is inserted from below, up through the slot 169 in the slide 168, so that wires W of cable C project upwardly from the mating face 30 of the housing 10, as shown in FIG. 36, having been guided into the part 18 of the bore 16 by the frusto-conical wall of the mouth 20. In the fully inserted position of the cable C, the end of the braid shield abuts against the stop shoulder 19 between the bore parts 16 and 20. As shown in FIG. 37, each wire end portion is then dressed, in a taut condition, into a respective predetermined notch 32 of the housing 10 so as to extend through a respective blind slot 181 and to bottom therein. As shown in FIG. 41 there is substantial clearance between the nest 180 and the wall 26 of the housing 10.

As shown in FIG. 38, the operator now takes up a housing 12, by its handling tab 120, and orients it above the housing 10 so that the tabs 100 and 120 are in alignment as shown.

The operator then lowers the housing 12 onto the housing 10 so that the wall 26 of the latter is received partially in the hood 48 of the former, the tab 120 of the housing 12 being received in the through slot 175 of the nest 180, thereby ensuring that the tabs 100 and 120 are in precise alignment so that the housings 10 and 12 are correctly angularly oriented with respect to each other (FIG. 38). It must be ensured by means of the levelling spigot 106 that the housings are level, with no noticeable degree of tilt.

Figure 39:
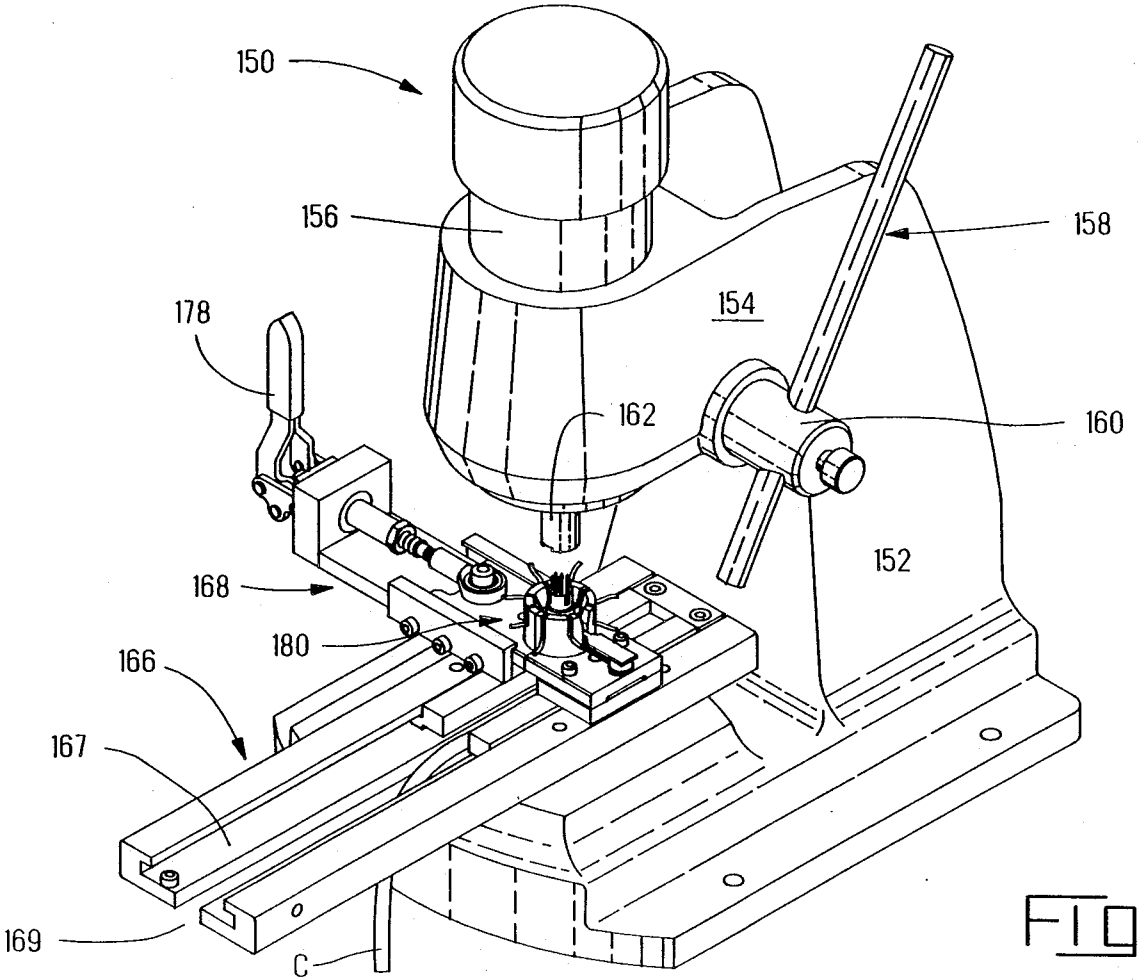
Figure 42:
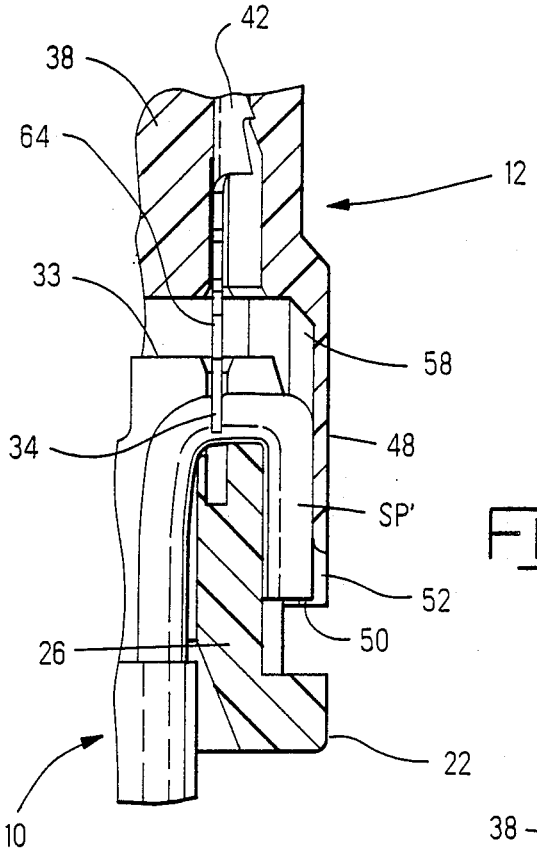
Figure 43:
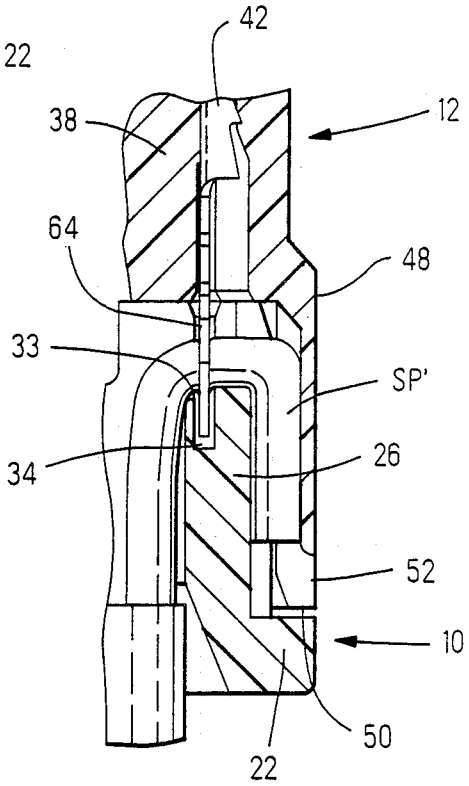

With the housings 10 and 12 so relatively positioned, the slide 168 is advanced by the operator as shown in FIG. 39, towards the ram 156, until the housing 12 lies directly beneath the applicator head 162 when the slide 168 has been arrested by a stop (not shown). The operator then raises the handle 158 so as to depress the ram 156 towards the slide 168 so that each wire 10 is trimmed between a respective shear blade 164 and a respective shear edge 186 as shown in FIG. 41. As the ram 156 advances further, the hood 48 of the housing 12 forces the severed end portion SP′ of each wire 10 down into the corresponding groove 28 of the housing 10 and as shown in FIGS. 42 and 43, the severed end portion SP′ is fully enclosed in the channel defined by the walls of the grooves 28 and 58. Also, as will be apparent from FIGS. 42 and 43, the wire connecting portion 64 of each contact element is forced through the part of the wire 10 which lies on the base 33 of the respective notch 32, into the part of the slot 34 there beneath, whereby the edges of the slot 66 in the wire connecting portion 64 cut through the insulation of the wire 10 and make permanent electrical contact with the metal core thereof. The edge 50 of the hood 48 bottoms against the collar 22 of the housing 10, when the housing 10 and 12 have been fully assembled to provide the sub-assembly 94. The flats 24 prevent a burr of the housing material from inhibitive complete closure of the tooling about the housing 10.

The operator now depresses the handle 158 thereby raising the ram 156 and retracting the slide 168 to its initial position, lowering the handle 178 to separate the two halves 182 and 184 of the rest 180 and removes the sub-assembly 94 therefrom, by means of the handling tabs 100 and 120.

Figure 40:
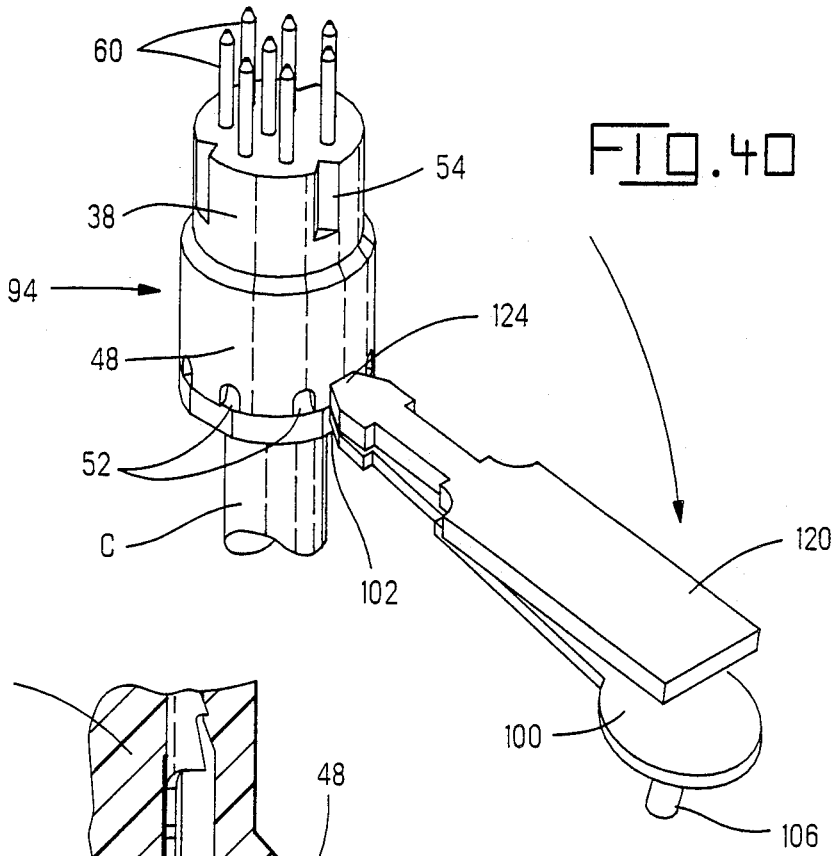

As indicated in FIG. 40, the operator manipulates the handling rams 100 and 120 so as to break them from their respective housings at their respective reduced cross-section portions 102 and 104.

The sub-assembly 94 so stripped of its tabs 100 and 120 is assembled to the shielding shell 14 as described above with reference to FIGS. 5 to 9, or to the shielding shell 14, as described with reference to FIGS. 33 and 34.

While the preferred embodiment has been described with reference to a pin contact, the invention is not limited thereto; a socket or other type of known contact could be used. While the wire housing and contact housings have been described as being held together by the shielding shell, other means for securing the wire and contact housings, such as a resilient latch on one housing riding over a ramp to latch behind a shoulder on the other housing. This would be particularly employed in unshielded connectors which may require a shroud extending from the forward portion of the contact housing.

We claim:

1. A method of producing a circular cross section electrical connector sub-assembly comprising a tubular, insulating, wire housing, a mating insulating contact housing and a shielded, multi-wire electrical cable, an end portion of which has been stripped to expose end portions of the cable wires and an end portion of the cable shielding, the method comprising the steps of;

(a) locating said wire housing in a jig by means of a handling tab projecting laterally from said wire housing;

(b) inserting the exposed wire end portions through said wire housing so as to project beyond said wire housing;

(c) dressing each wire end portion into a notch in an end of said wire housing so as to lie across a slot. therein;

(d) positioning said contact housing by means of a handling tab projecting laterally therefrom, onto said wire housing and positioning said contact housing with respect thereto to urge said wire end portions against said end;

(e) trimming said wire end portions at positions beyond said notches;

(f) applying a force to said contact housing to mate said housings and thereby to insert each wire connecting portion of a respective contact element of said contact housing into a respective one of said slots in said wire housing to make electrical contact with a respective one of said wire end portions; and (g) removing said mated housings and said cable end portion, which constitute said sub-assembly from said jig.

2. A method as claimed in claim 1, comprising the further step of breaking said handling tabs away from said mated housings, following step (g).

3. A method as claimed in claim I, comprising the step of moving two parts of the jig away from each other to place the jig in an open position prior to carrying out step (a), and moving said parts towards each other to close said jig immediately following step (a).

4. A method as claimed in claim I, wherein step (a) includes the step of locating said wire housing in said position by engaging an end of a levelling member on the handling tab of said wire housing with a reference surface proximate to said jig.

5. A method as claimed in claim 1, wherein step (d) includes the step of locating said housings in said position by engaging an end of a levelling member on the handling tab of said wire housing with a reference surface proximate to said jig.

6. A method as claimed in claim 1, wherein step (f) includes the step of forcing trimmed end portions of wires projecting beyond the upper surface of said wire housing into channels defined by said housings.

7. A method as claimed in claim 1, wherein step (c) includes the step of engaging each wire end portion with the bottom of the respective notch so that none of said wire end portions projects above the upper end of said wire housing.

8. A method as claimed in claim 1, comprising the further step of inserting said mated housings into a tubular metal shielding shell fully surrounding said housings and crimping at least one part of said shielding shell to said cable shielding thereby to secure said housings in said shell, and to close the shell about said cable end portion.

9. A method as claimed in claim 8, wherein said at least one part comprises a pair of lugs projecting from an end of the shell and in which method the lugs are crimped down so as to embrace said cable shielding.

10. A method as claimed in claim 8, wherein said shell is a seamless drawn shell said at least one part being an end portion of the shell and in which method said end portion is crimped to star shape about said cable shielding.

11. A method as claimed in claim 8, comprising the further step of molding an insulating cover about said shell and said end portion of said cable shielding.

* * * * *